US009639029B2

(12) United States Patent
Noguchi et al.

(10) Patent No.: US 9,639,029 B2
(45) Date of Patent: May 2, 2017

(54) IMAGE FORMING APPARATUS HAVING A ROTATIONAL PORTION WHICH ACCOMMODATES A DEVELOPER

(71) Applicant: FUJI XEROX CO., LTD., Tokyo (JP)

(72) Inventors: Ayumi Noguchi, Kanagawa (JP); Shota Oba, Kanagawa (JP); Norihiro Tamazawa, Kanagawa (JP); Makoto Kanno, Kanagawa (JP); Seigo Shinozaki, Kanagawa (JP); Keisuke Kubo, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/996,877

(22) Filed: Jan. 15, 2016

(65) Prior Publication Data

US 2017/0090349 A1 Mar. 30, 2017

(30) Foreign Application Priority Data

Sep. 25, 2015 (JP) ..... 2015-188804

(51) Int. Cl.
*G03G 15/08* (2006.01)

(52) U.S. Cl.
CPC ..... *G03G 15/0891* (2013.01); *G03G 15/0839* (2013.01)

(58) Field of Classification Search
CPC ..... G03G 15/0832; G03G 15/0836; G03G 15/0837; G03G 15/0839
USPC ..... 399/258, 262, 263
See application file for complete search history.

(56) References Cited

U.S. PATENT DOCUMENTS

2011/0097094 A1* 4/2011 Hamano ..... G03G 15/0856 399/27
2013/0330105 A1 12/2013 Komatsu et al.
2014/0079414 A1* 3/2014 Amauchi ..... G03G 15/0877 399/27

FOREIGN PATENT DOCUMENTS

JP 2012-141382 A 7/2012
JP 2013-254181 A 12/2013

* cited by examiner

*Primary Examiner* — Hoang Ngo
(74) *Attorney, Agent, or Firm* — Oliff PLC

(57) ABSTRACT

An image forming apparatus includes an accommodation container, a storage medium, and a controller. The accommodation container includes a rotational portion and outflow portion. The rotational portion accommodates a developer therein and has a helical-shaped transport section formed in an inner surface thereof. The outflow portion rotatably supports the rotational portion and has an outflow port through which the developer transported during rotation of the rotational portion flows out. The storage medium stores use state information of the developer accommodated in the rotational portion. The controller controls a driving source which drives the rotational portion. When a use state of the accommodation container for the developer is a use state which is set in advance, the controller intermittently drives the rotational portion by performing driving at a rotation angle of $(n+\frac{1}{2})\pi\pm18$ degrees or less than 90 degrees and stopping.

3 Claims, 14 Drawing Sheets

(FIG.6 Continued)
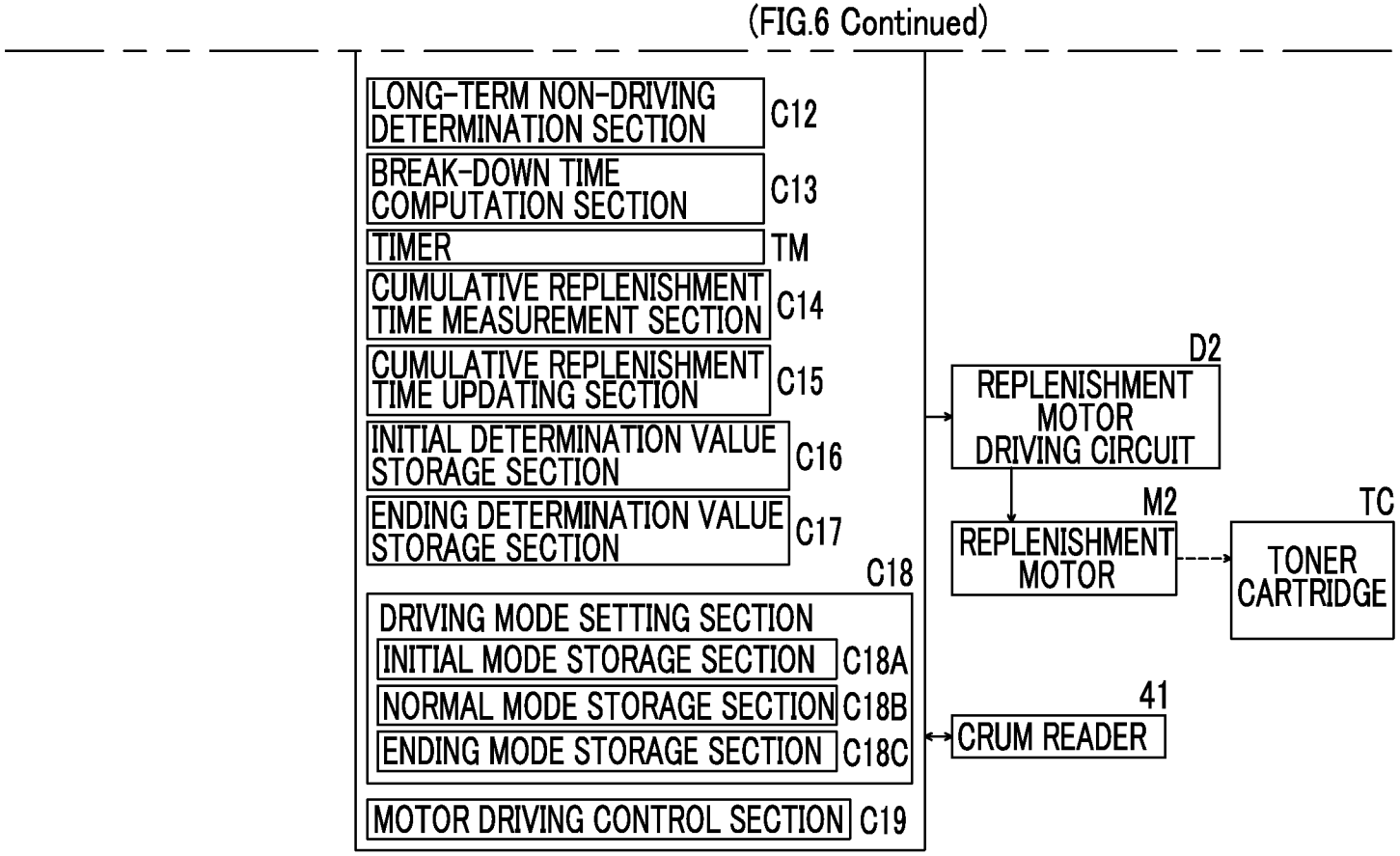

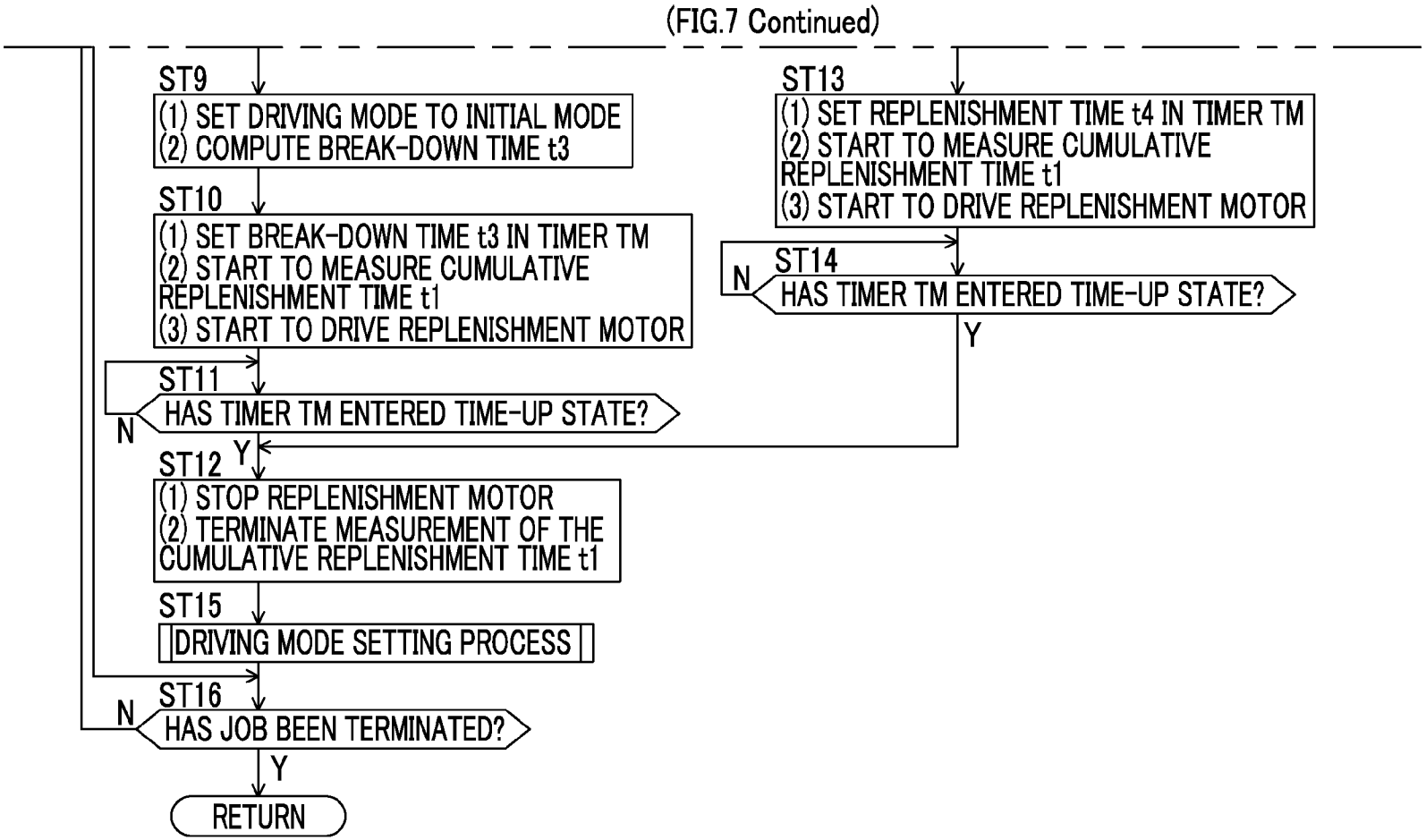
(FIG.7 Continued)
ST9
(1) SET DRIVING MODE TO INITIAL MODE
(2) COMPUTE BREAK-DOWN TIME t3
ST10
(1) SET BREAK-DOWN TIME t3 IN TIMER TM
(2) START TO MEASURE CUMULATIVE REPLENISHMENT TIME t1
(3) START TO DRIVE REPLENISHMENT MOTOR
ST11
HAS TIMER TM ENTERED TIME-UP STATE?
N
Y
ST12
(1) STOP REPLENISHMENT MOTOR
(2) TERMINATE MEASUREMENT OF THE CUMULATIVE REPLENISHMENT TIME t1
ST13
(1) SET REPLENISHMENT TIME t4 IN TIMER TM
(2) START TO MEASURE CUMULATIVE REPLENISHMENT TIME t1
(3) START TO DRIVE REPLENISHMENT MOTOR
ST14
HAS TIMER TM ENTERED TIME-UP STATE?
N
Y
ST15
DRIVING MODE SETTING PROCESS
ST16
HAS JOB BEEN TERMINATED?
N
Y
RETURN

IMAGE FORMING APPARATUS HAVING A ROTATIONAL PORTION WHICH ACCOMMODATES A DEVELOPER

CROSS-REFERENCE TO RELATED APPLICATIONS

This application is based on and claims priority under 35 USC 119 from Japanese Patent Application No. 2015-188804 filed Sep. 25, 2015.

BACKGROUND

Technical Field

The present invention relates to an image forming apparatus.

SUMMARY

According to an aspect of the invention, an image forming apparatus includes an accommodation container, a storage medium, and a controller. The accommodation container includes a rotational portion and outflow portion. The rotational portion accommodates a developer therein and has a helical-shaped transport section formed in an inner surface thereof. The outflow portion rotatably supports the rotational portion and has an outflow port through which the developer transported during rotation of the rotational portion flows out. The storage medium stores use state information of the developer accommodated in the rotational portion. The controller controls a driving source which drives the rotational portion. When a use state of the accommodation container for the developer is a use state which is set in advance, the controller intermittently drives the rotational portion by performing driving at a rotation angle of $(n+\frac{1}{2})\pi\pm18$ degrees or less than 90 degrees and stopping.

BRIEF DESCRIPTION OF THE DRAWINGS

Exemplary embodiments of the present invention will be described in detail based on the following figures, wherein:

FIG. 9A is a diagram illustrating a force acting on the developer when rotation is started, FIG. 9B is a diagram illustrating a state where the rotational portions are rotated by 90 degrees from the state in FIG. 9A, FIG. 9C is a diagram illustrating a force acting when the rotational portions are rotated by 90 degrees from the state in FIG. 9B and is then stopped, and FIG. 9D is a diagram illustrating a force acting when the rotational portions are rotated by 180 degrees from the state in FIG. 9C and is then stopped;

FIG. 10A is a diagram illustrating a force acting on a developer when rotation is started, FIG. 10B is a diagram illustrating a state where the rotational portions are rotated by 270 degrees from the state in FIG. 10A, FIG. 10C is a diagram illustrating a state where the rotational portions are rotated by 270 degrees from the state in FIG. 10B, and FIG. 10D is a diagram illustrating a state where the rotational portions are rotated by 270 degrees from the state in FIG. 10C;

FIG. 11A is a diagram illustrating a state before driving is started, FIG. 11B is a diagram illustrating a state after the driving is terminated, and FIG. 11C is a diagram illustrating a case where the rotational portion is stopped at a position where the rotational portion is rotated by 180 degrees.

DETAILED DESCRIPTION

Figure 1:
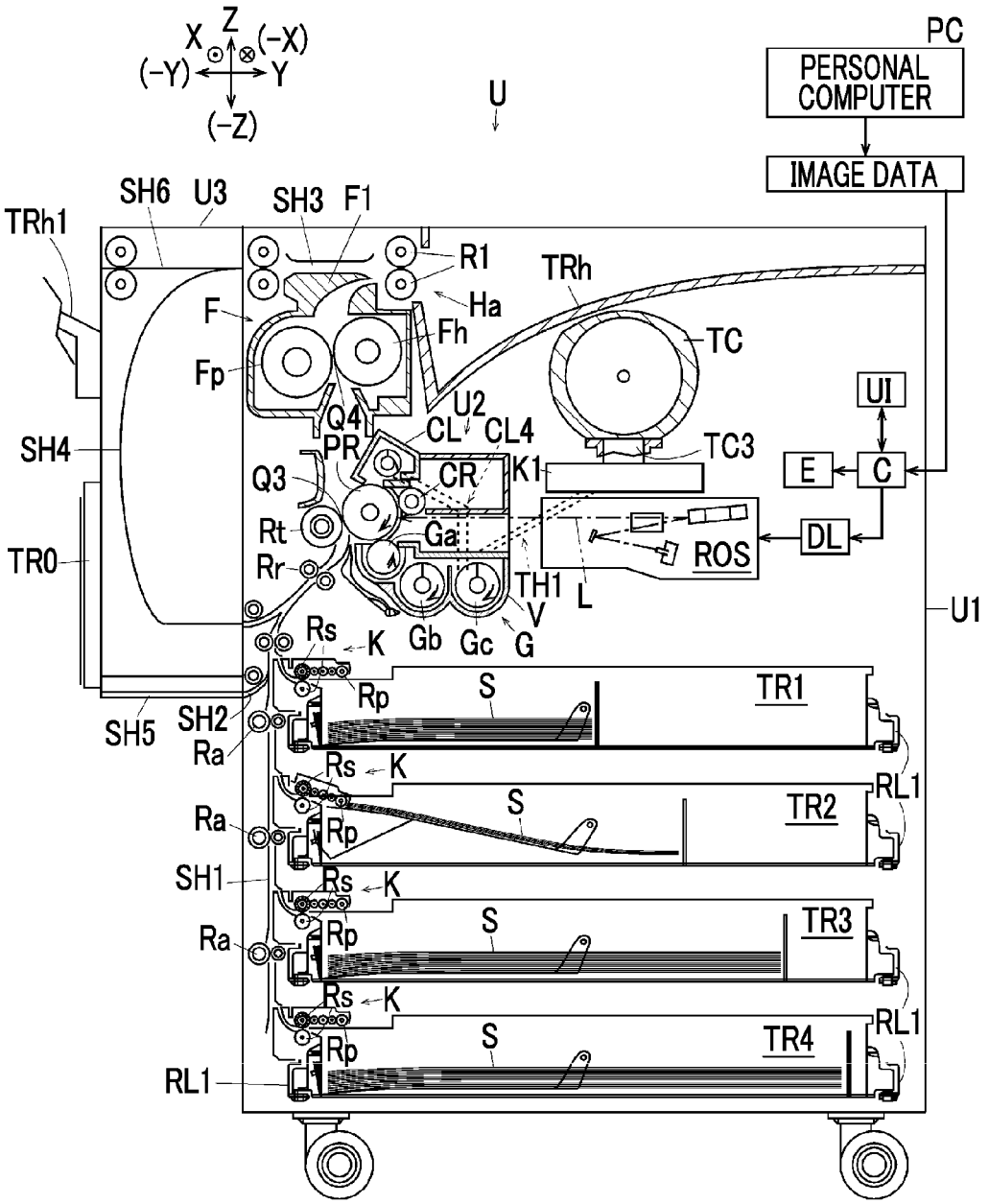
FIG. 1 is a diagram illustrating the entire image forming apparatus according to Example 1.

Hereinafter, a specific example (hereinafter, referred to as an example) of an exemplary embodiment of the present invention will be described with reference to the accompanying drawings, but the present invention is not limited to the following example.

Meanwhile, for convenience of the following description, in the drawings, a front-and-back direction is assumed to be an X-axis direction, a right-and-left direction is assumed to be a Y-axis direction, an up-down direction is assumed to be a Z-axis direction, and directions and sides indicated by arrows X, −X, Y, −Y, Z, and −Z are assumed to be forward, backward, rightward, leftward, upward, and downward, or a front side, a back side, a right side, a left side, an upper side, and a lower side, respectively.

In the drawings, "·" described within "○" indicates an arrow toward the front from the back of a paper surface, and "×" described within "○" indicates an arrow toward the back from the front of a paper surface.

Meanwhile, in a description using the following drawings, members except for members necessary for the description are not appropriately shown for ease of understanding.

Example 1

FIG. 1 is a diagram illustrating the entire image forming apparatus according to Example 1.

In FIG. 1, a printer U as an example of an image forming apparatus according to Example 1 includes a printer main body U1 as an example of an apparatus main body. A first exit tray TRh as an example of an exit section for a first medium is provided on the upper surface of the printer main body U1. An operation section UI is provided on a right upper surface of the printer main body U1. The operation section UI includes a display section not shown in the drawing, and the like. The operation section UI is configured such that a user performs an input operation thereon.

A host computer illustrated as an example of a device for transmitting image information, specifically, a personal computer is electrically connected to the printer U according to Example 1.

The printer U includes a controller C as an example of a controller. The controller C may receive image information transmitted from a personal computer PC or an electrical signal such as a control signal. In addition, the controller C is configured to be able to output a control signal to the operation section UI or an electric circuit E. Further, the controller C is electrically connected to a write circuit DL.

The write circuit DL outputs a driving signal to an exposing device ROS as an example of a write device in accordance with information which is input. The exposing device ROS is configured to be able to output a laser beam L as an example of a write light beam in accordance with the input signal.

Figure 2:
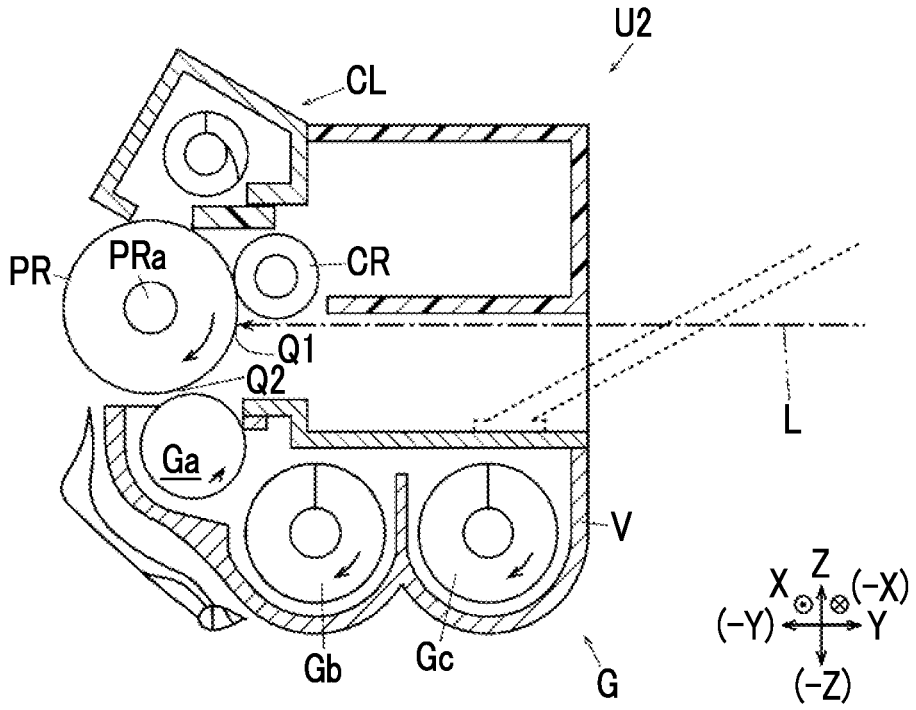
FIG. 2 is an enlarged view of main components of an apparatus of forming a toner image of FIG. 1.

FIG. 2 is an enlarged view of main components of an apparatus of forming a toner image of FIG. 1.

In FIGS. 1 and 2, a photoconductor PR as an example of an image holding body is disposed on the left side of the exposing device ROS. The photoconductor PR according to Example 1 is supported so as to be rotatable about a rotary shaft PRa in a direction of an arrow. The photoconductor PR is irradiated with a laser beam L in a write region Q1.

A charging roller CR as an example of a charging member, a developing device G, and a photoconductor cleaner CL as an example of a cleaner for an image holding body are disposed in the vicinity of the photoconductor PR along a rotation direction of the photoconductor PR.

Meanwhile, in the printer U according to Example 1, the photoconductor PR, the charging roller CR, the developing device G, and the photoconductor cleaner CL are integrally unitized so as to be attachable and detachable. That is, the photoconductor PR, the charging roller CR, the developing device G, and the photoconductor cleaner CL are configured so as to be attachable and detachable to and from the printer main body U1 as a process unit U2.

A charging voltage is applied to the charging roller CR from the electric circuit E.

The developing device G includes a developing container V that accommodates a toner as an example of a developer therein. A developing roller Ga as an example of a developer holding body is rotatably supported within the developing container V. The developing roller Ga is disposed facing the photoconductor PR in a developing region Q2.

In addition, a developing voltage is applied to a developing roller Ga from a power supply circuit E. In addition, augers Gb and Gc as examples of a developer transport member are rotatably supported within the developing container V.

A the photoconductor PR, the charging roller CR, the exposing device ROS, the developing device G, and the like make up a toner image forming apparatus for forming a toner image on the photoconductor PR.

An end of a replenishment path of a toner replenishing device TH1 as an example of a developer replenishing device which is fixedly supported by the printer U is connected to the developing container V. The other end of the replenishment path of the toner replenishing device TH1 is connected to a toner cartridge TC as an example of a developer accommodation container.

The toner cartridge TC is configured to be attachable and detachable by being inserted into and extracted from the printer U in the front-and-back direction.

In FIG. 1, plural paper feed trays TR1 to TR4 as examples of a medium accommodating portion are provided in a lower portion of the printer U. The plural paper feed trays TR1 to TR4 accommodate a recording sheet S as an example of a medium.

In FIG. 1, a rail RL1 as an example of a guide member for a container is disposed on both right and left sides of each of the paper feed trays TR1 to TR4. The rail RL1 movably supports both right and left ends of each of the paper feed trays TR1 to TR4. Therefore, each of the paper feed trays TR1 to TR4 is supported by the pair of right and left rails RL1 so that the exit and entrance thereof are allowed in the front-and-back direction.

In FIG. 1, a paper feed device K is disposed at an upper left portion of each of the paper feed trays TR1 to TR4. The paper feed device K includes a pickup roller Rp as an example of a medium taking-out member. A separation roller Rs as an example of a separation member is disposed on the left side of the pickup roller Rp. The separation roller Rs is configured with a feed roller as an example of a medium transport member and a retard roll as an example of a medium detaching member.

A paper feed path SH1 as an example of a medium transport path is disposed on the left side of the paper feed device K. The paper feed path SH1 extends upward. Plural transport rollers Ra as examples of a medium transport member are disposed at the paper feed path SH1. A register roller Rr as an example of a member of adjusting a medium transport timing is disposed at an upper end which is a downstream end of the paper feed path SH1.

In addition, a manual feed tray TR0 as an example of a manual feed section is mounted to a left portion of the printer U. A left end of a manual feed path SH2 as an example of a transport path for manual feed is connected to a right portion of the manual feed tray TR0. A right end of the manual feed path SH2 is connected to the paper feed path SH1.

In FIG. 1, a transfer roller Rt as an example of a transfer device is disposed on the upper side of the register roller Rr. The transfer roller Rt faces and contacts with the photoconductor PR in a transfer region Q3. Therefore, the transfer roller Rt according to Example 1 is rotated following the rotation of the photoconductor PR. A transfer voltage is applied to the transfer roller Rt from the power supply circuit E.

The photoconductor cleaner CL is disposed on a downstream side of the transfer roller Rt with respect to a rotation direction of the photoconductor PR. A recovering path CL4 as an example of a developer transport path is supported by the photoconductor cleaner CL. The recovering path CL4 extends from the photoconductor cleaner CL to the developing device G.

In FIG. 1, a fixation device F is supported on the upper side of the transfer roller Rt. The fixation device F includes a heating roller Fh as an example of a heating fixation member and a pressing roller Fp as example of a pressing fixation member. The heating roller Fh and the pressing roller Fp contacts with each other in a fixation region Q4. The heating roller Fh is rotated by driving transmitted from a driving source not shown in the drawing. In addition, power for heating a heater not shown in the drawing is supplied to the heating roller Fh from the electric circuit E.

The process unit U2 as an example of the toner image forming apparatus, the transfer roller Rt, and the fixation device F make up an image recording section U2+Rt+F that records an image on a sheet S.

A sheet guide F1 as an example of a medium guide portion is formed in an upper portion of the fixation device F. An ejection roller R1 as an example of a medium exit member is disposed on the right side of the sheet guide F1. A medium exit port Ha is formed on the right side of the ejection roller R1. The first exit tray TRh is disposed on the lower side of the medium exit port Ha.

In FIG. 1, a connection path SH3 as an example of a medium transport path is disposed on the upper side of the fixation device F and on the left side of the ejection roller R1. The connection path SH3 extends leftward from the medium exit port Ha.

A reversing unit U3 as an example of a medium reversing device is supported on the upper side of the manual feed tray TR0 on the left surface of the printer main body U1. A reversing path SH4 as an example of a medium transport path is formed inside the reversing unit U3. An upper end of the reversing path SH4 is connected to a left end of the connection path SH3. A lower end of the reversing path SH4 unites with the paper feed path SH1 on an upstream side of the register roller Rr.

In addition, a second exit path SH6 as an example of a medium transport path is formed in the upper portion of the reversing unit U3. A right end of the second exit path SH6 is connected to the connection path SH3, and is branched from the reversing path SH4. A left end of the second exit path SH6 extends up to the left side surface of the reversing unit U3. A face-up tray TRh1 as an example of a second exit section is supported by the left side surface of the reversing unit U3. Therefore, the sheet S having passed through the second exit path SH6 is configured to be capable of being discharged to the face-up tray TRh1.

Function of Image Forming Apparatus

In the printer U according to Example 1 which having the above-described configuration, image information transmitted from the personal computer PC is input to the controller C. The controller C converts the input image information into information for forming a latent image at a timing set in advance and outputs the converted information to the write circuit DL. The exposing device ROS outputs a laser beam L based on a signal received by the write circuit DL. Meanwhile, the controller C controls the operation of the operation section UI, the write circuit DL, the power supply circuit E, and the like.

In FIGS. 1 and 2, the surface of the photoconductor PR is charged by the charging roller CR to which a charging voltage is applied. The surface of the photoconductor PR which is charged by the charging roller CR is exposed by and irradiated with the laser beam L of the exposing device ROS in the write region Q1, and thus an electrostatic latent image is formed thereon. The surface of the photoconductor PR having the electrostatic latent image formed thereon sequentially passes through the developing region Q2 and the transfer region Q3.

In the developing region Q2, the developing roller Ga faces the photoconductor PR. The developing roller Ga is rotated while holding a developer inside the developing container V on the surface thereof. Therefore, the electrostatic latent image formed on the surface of the photoconductor PR is developed into a toner image as an example of a visible image by the toner image held on the surface of the developing roller Ga. The developer inside the developing container V is circulated while being agitated by the augers Gb and Gc.

When the developer inside the developing container V is consumed in association with development by the developing roller Ga, a developer is replenished from the toner cartridge TC. That is, a toner within the toner cartridge TC is transported to an exit port TC3 in accordance with the amount of developer consumed. The toner discharged from the exit port TC3 is transported to the developing container V by a transport member for replenishment, not shown in the drawing, within the replenishment path of the toner replenishing device TH1.

Sheets S having an image recorded thereon are accommodated in each of the paper feed trays TR1 to TR4. The sheets S accommodated in each of the paper feed trays TR1 to TR4 are taken out by the pickup roller Rp of the paper feed device K. The sheets S taken out by the pickup roller Rp are separated one by one by the separation roller Rs. The sheets S separated by the separation roller Rs are fed to the paper feed path SH1. The sheets S in the paper feed path SH1 are transported toward the register roller Rr by the transport roller Ra.

Meanwhile, the sheets S fed from the manual feed tray TR0 are transported to the register roller Rr through the manual feed path SH2. The sheets S transported to the register roller Rr are transported to the transfer region Q3 by the register roller Rr in accordance with a timing when the toner image formed on the surface of the photoconductor PR is moved to the transfer region Q3.

In the transfer region Q3, the toner image formed on the surface of the photoconductor PR is transferred to the sheet S passing through the transfer region Q3 by the transfer roller Rt to which a transfer voltage is applied.

In FIG. 2, the photoconductor PR having passed through the transfer region Q3 is cleaned by removing a toner attached to the surface thereof by the photoconductor cleaner CL. The toner removed by the photoconductor cleaner CL is returned to the inside of the developing container V through the recovering path CL4. That is, a developer recovered by the photoconductor cleaner CL is used again in the developing device G.

The photoconductor PR having the surface cleaned by the photoconductor cleaner CL is charged again by the charging roller CR.

The sheet S having the toner image transferred thereto in the transfer region Q3 is transported to the fixation region Q4 of the fixation device F in a state were the toner image is not fixed.

In the fixation region Q4, the sheet S is interposed between the heating roller Fh and the pressing roller Fp, and thus to toner image is heated and fixed.

The sheet S having the toner image fixed by the fixation device F is guided to the sheet guide F1 and is transported to the ejection roller R1. When the sheet S is discharged to the first exit tray TRh, the sheet S sent to the ejection roller R1 is discharged from the medium exit port Ha to the first exit tray TRh.

During duplex printing, the ejection roller R1 is reversely rotated backward in a state where a rear end in a transport direction of the sheet S having an image recorded on one surface thereof has passed through the sheet guide F1. Therefore, the sheet S is transported to the reversing path SH4 through the connection path SH3. The sheet S transported through the reversing path SH4 is transported to the register roller Rr with the front and back sides thereof reversed. Therefore, the sheet is sent again to the transfer region Q3 from the register roller Rr, and thus an image on the other surface thereof is recorded thereon.

When the sheet S is discharged to the face-up tray TRh1, the sheet S transported through the connection path SH3 by the backward rotation of the ejection roller R1 is carried into the second exit path SH6. The sheet S transported through the second exit path SH6 is discharged to the face-up tray TRh1.

Description of Toner Cartridge

Figure 3:
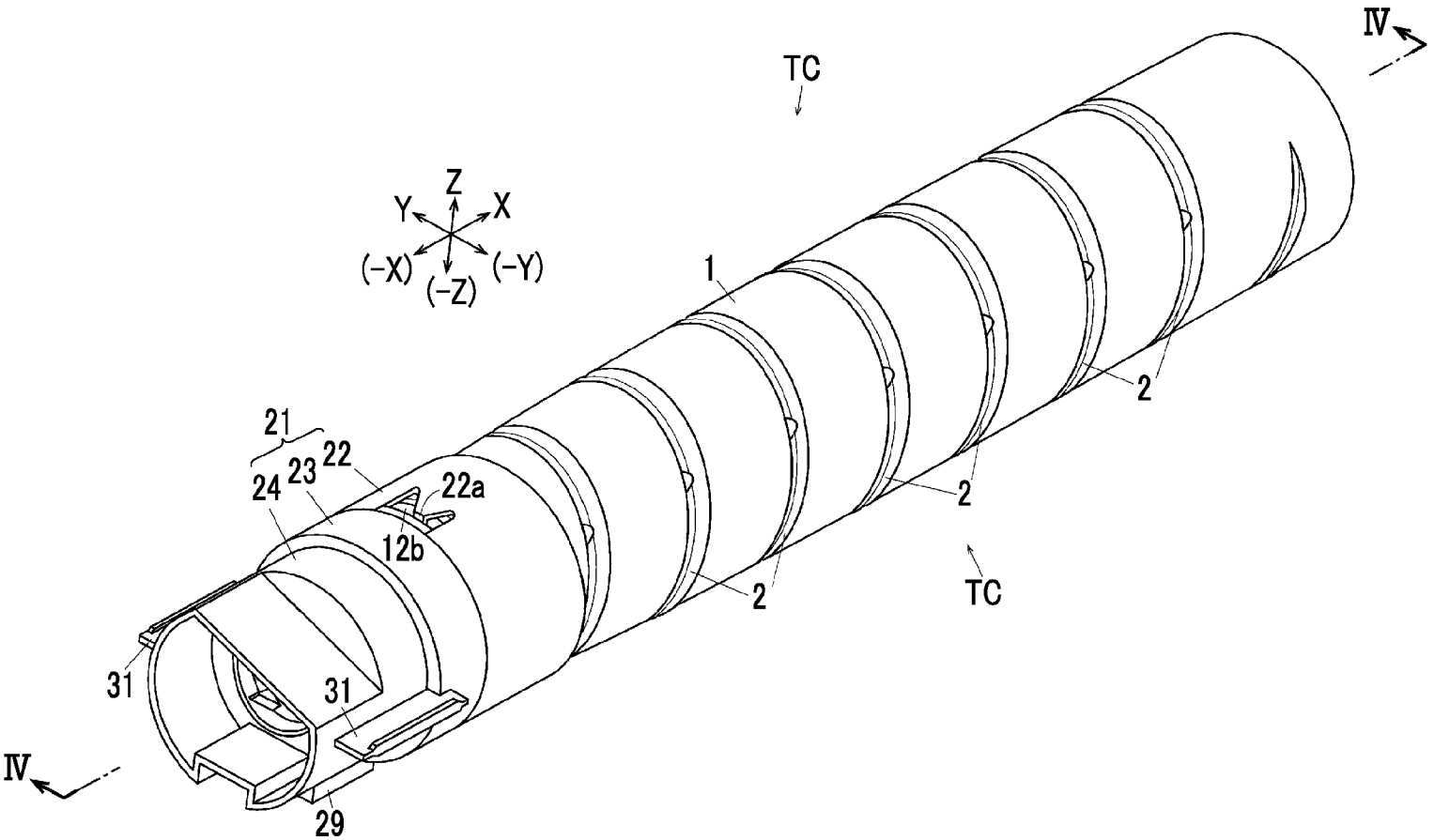
FIG. 3 is a perspective view of a toner cartridge according to Example 1.

FIG. 3 is a perspective view of a toner cartridge according to Example 1.

Figure 4:
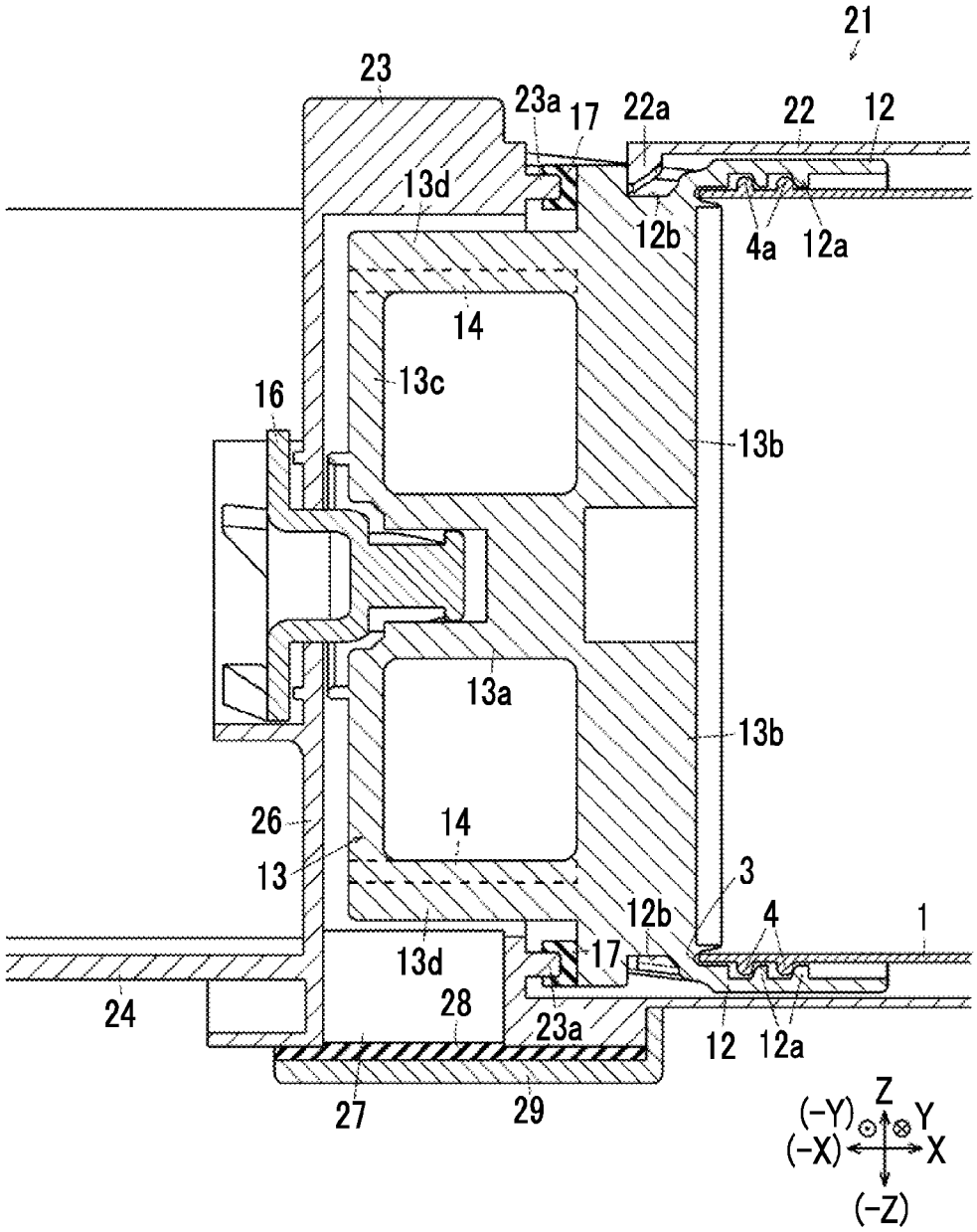
FIG. 4 is a cross-sectional view taken along a line IV-IV in FIG. 3.

FIG. 4 is a cross-sectional view taken along a line IV-IV in FIG. 3.

In FIGS. 3 and 4, the toner cartridge TC as an example of a detachable body includes a bottle 1 as an example of an accommodating portion. The bottle 1 is formed to have a cylindrical shape extending in the front-and-back direction, and is configured to be able to accommodate a developer therein. A helical-shaped groove portion 2 as an example of a transport section is formed in a wall surface of the bottle 1. In FIGS. 3 and 4, an opening 3 is formed in a rear end of the bottle 1. A screw portion 4 as an example of a fastening portion is formed on the outer surface of the bottle 1 at a position on the front side of the opening 3.

Figure 5:
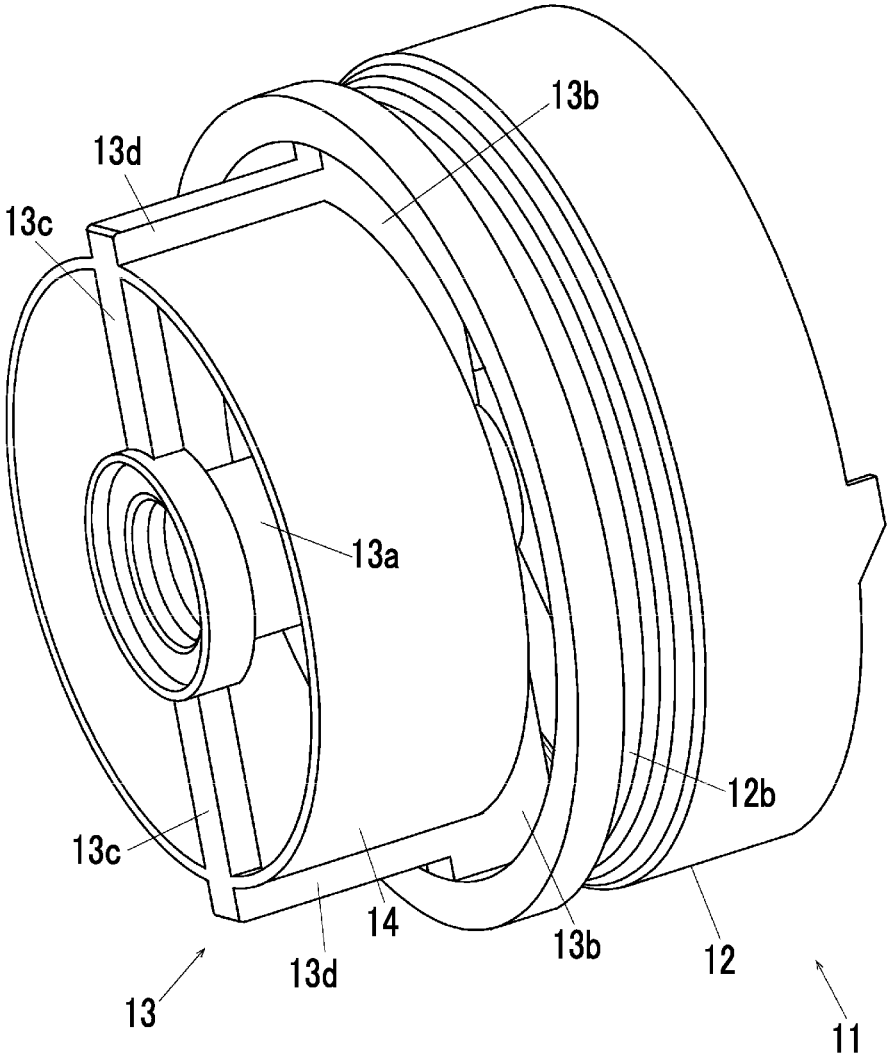
FIG. 5 is a diagram illustrating a fin member according to Example 1.

FIG. 5 is a diagram illustrating a fin member according to Example 1

In FIGS. 3 to 5, a fin member 11 as an example of a break-down member is disposed on the rear side of the bottle 1. The fin member 11 includes a cylindrical portion 12 on the front side thereof and a fin main body 13 on the rear side thereof. The cylindrical portion 12 is provided with a screw portion 12*a* as an example of a fastening portion on the inner circumferential surface thereof. The screw portion 12*a* is formed corresponding to the screw portion 4. Accordingly, the screw portion 12*a* and the screw portion 4 engage with each other, and thus the fin member 11 and the bottle 1 are fastened to each other. Therefore, the fin member 11 and the bottle 1 make up the rotational portions 1 and 11 according to Example 1.

In addition, a ring-shaped recessed groove 12*b* is formed in the outer circumference of the rear portion of the cylindrical portion 12.

The fin main body 13 includes a shaft portion 13*a* extending in the front-and-back direction. A supporting arm 13*b* extending outward in the radial direction is formed at the front end of the shaft portion 13*a*, as an example of a break-down portion and an example of a to-be-supported object. The outer end of the supporting arm 13*b* is connected to the inner circumferential surface of the cylindrical portion 12.

A first break-down portion 13*c* extending outward in the radial direction is formed in the rear portion of the shaft portion 13*a*. A second break-down portion 13*d* extending in the front-and-back direction is formed between a radial outer end of the first break-down portion 13*c* and the supporting arm 13*b*.

A cylindrical wall member 14 is integrally formed on the inner side of the second break-down portion 13*d*. In FIG. 4, a gap is formed between the wall member 14 according to Example 1 and an upper end of an exit path 27 to be described later. In Example 1, the gap is set to 5 mm, but the amount of developer desired to be transported per unit time, and the like may be arbitrarily modified depending on the design and use.

A coupling 16 as an example of a transmission member to be driven is supported by the rear end of the shaft portion 13*a*. When the toner cartridge TC is mounted to the printer main body U1, the coupling 16 engages with a coupling supported by the printer main body U1 to receive a driving force therefrom.

In FIGS. 4 and 5, a toner seal 17 as an example of a leakage prevention member is supported by the rear end face of the cylindrical portion 12. The toner seal 17 is formed to have an annular shape, that is, a ring shape along the rear end face of the cylindrical portion 12. Meanwhile, the toner seal 17 is formed of any material capable of preventing the leakage of a developer, and a foaming member such as sponge may be adopted.

A flange portion 21 as an example of an outflow portion is supported on the rear side of the fin member 11. The flange portion 21 is configured to have a cylindrical shape. The flange portion 21 includes an intermediate diameter portion 22 which is a front portion, a large diameter portion 23 in the middle in the front-and-back direction, and a small diameter portion 24 which is a rear portion.

The intermediate diameter portion 22 has such an inner diameter as to cover the outer circumference of the rear portions of the rotational portions land 11. The intermediate diameter portion 22 is provided with a claw portion 22*a* as an example of a connecting portion. The claw portion 22*a* is disposed at a position corresponding to the ring-shaped recessed groove 12*b*, and extends inward in the radial direction. The claw portion 22*a* contacts with the recessed groove 12*b* to restrict the forward movement of the rotational portions 1 and 11 with respect to the flange portion 21. That is, the rotational portions 1 and 11 and the flange portion 21 are connected to each other. Although only one claw portion 22*a* is illustrated in FIG. 3, plural claw portions may be disposed along the circumferential direction of the cylindrical intermediate diameter portion 22.

A ring-shaped projection portion 23*a* as an example of a biting-into portion is formed at the front end of the large diameter portion 23. Accordingly, when the flange portion 21 and the rotational portions 1 and 11 are connected to each other, the projection portion 23*a* is supported while compressing the toner seal 17 so as to bite into the toner seal 17.

A plate-shaped wall portion 26 extending in the up-down direction and right-and-left direction is formed in a boundary portion between the large diameter portion 23 and the small diameter portion 24. The coupling 16 is rotatably supported by the wall portion 26 in a penetrating state.

The exit path 27 extending downward is formed on the lower side of the wall portion 26. An exit port 28 as an example of an opening is formed at a lower end of the exit path 27. A shutter 29 as an example of an opening and closing member is supported by the exit port 28. The shutter 29 is moved to a position for opening the exit port 28 when the toner cartridge TC is mounted to the printer main body U1, and is moved to a position for closing the exit port 28 when the toner cartridge TC is separated from the printer main body U1.

In FIG. 3, an insertion guide 31 as an example of a portion to be guided is formed on the outer circumferential surface of the small diameter portion 24. When the toner cartridge TC is mounted, the insertion guide 31 is guided to a guide portion, not shown in the drawing, which is provided in the printer main body U1 as an example of a main body of the image forming apparatus.

Description of Controller According to Example 1

Figure 6:
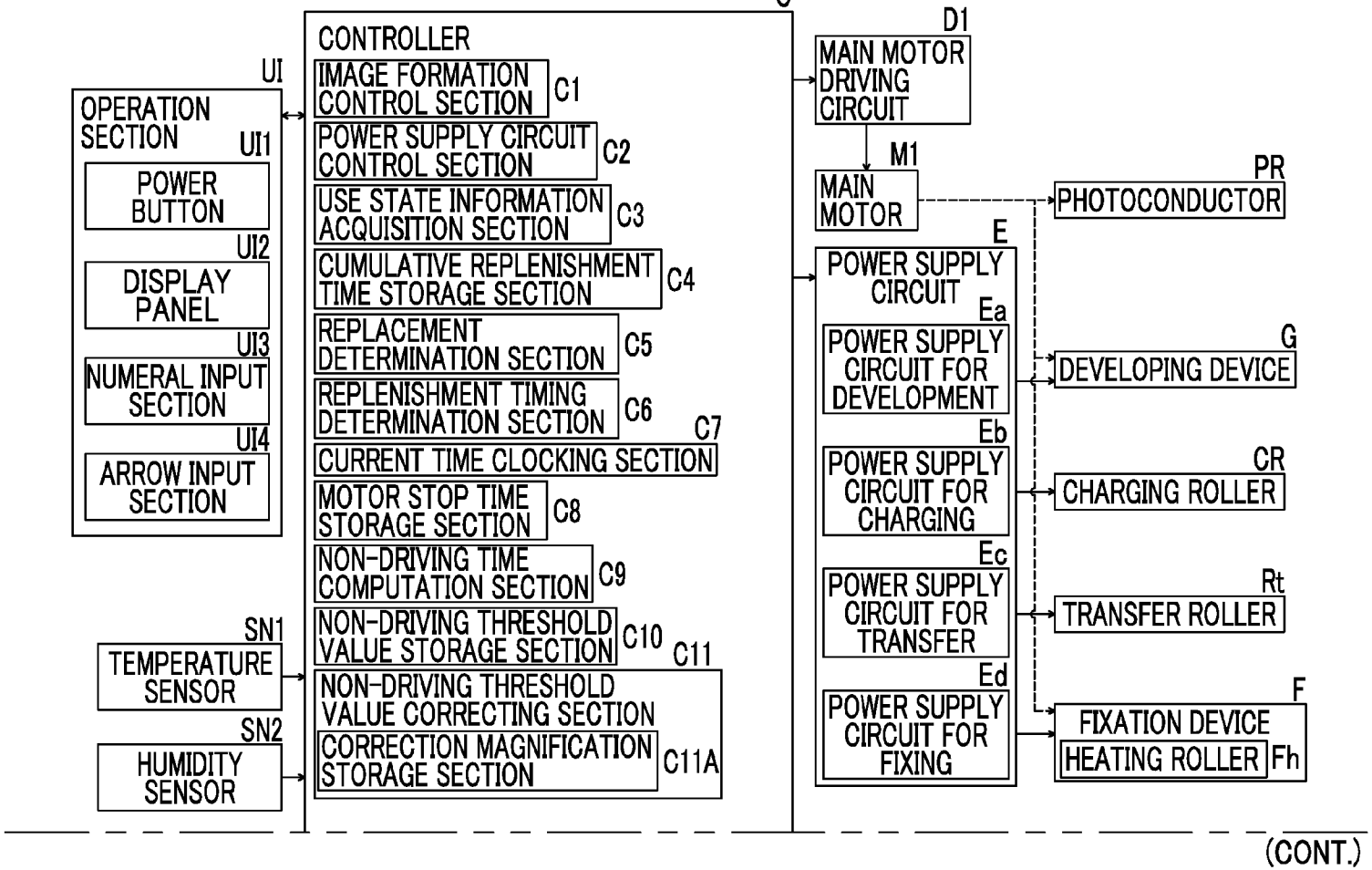
FIG. 6 is a block diagram illustrating functions of a controller of the image forming apparatus according to Example 1 of the present invention.

FIG. 6 is a block diagram illustrating functions of a controller of the image forming apparatus according to Example 1 of the present invention.

In FIG. 6, the controller C of the printer U includes an input/output interface I/O for inputting and outputting a signal to and from the outside. In addition, the controller C includes a read only memory (ROM) that stores programs, information, and the like for performing necessary processes. In addition, the controller C includes a random access memory (RAM) for temporarily storing necessary data. In addition, the controller C includes a central processing unit (CPU) that performs processes according to the programs stored in the ROM and the like. Therefore, the controller C according to Example 1 is configured with a small information processing apparatus, that is, a so-called microcomputer. Accordingly, the controller C may realize various functions by executing the programs stored in the ROM and the like.

Signal Output Element Connected to Controller C of Printer U

The controller C of the printer U receives an input of an output signal from a signal output element such as the operation section UI, a temperature sensor SN1, or a humidity sensor SN2.

The operation section UI includes a power button UI1 as an example of a power-on section, a display panel UI2 as an example of a display section, a numeral input section UI3, an arrow input section UI4, and the like.

The temperature sensor SN1 as an example of an environment detecting section measures an environmental temperature in an environment in which the printer U is installed.

The humidity sensor SN2 as an example of an environment detecting section measures an environmental humidity in an environment in which the printer U is installed.

Controlled Element Which is Connected to Controller C of Printer U

The controller C of the printer U is connected to a main motor driving circuit D1 that drives a main motor as an example of a driving circuit of a main driving source, a replenishment motor driving circuit D2 that drives a replenishment motor and serves as an example of a driving circuit of a driving source for replenishment, a power supply circuit E, a CRUM reader 41 as an example of an information read and write device, and other control elements not shown in the drawing. The controller C outputs controls signals of the circuits D1, D2, and E, and the like to the circuits and the like.

D1: Main Motor Driving Circuit

The main motor driving circuit D1 rotates the photoconductor PR and the like through a main motor M1 as an example of a main driving source.

D2: Replenishment Motor Driving Circuit

The replenishment motor driving circuit D2 rotates the rotational portions 1 and 11 of the toner cartridge TC through a replenishment motor M2 as an example of a driving source for replenishment.

E: Power Supply Circuit

The power supply circuit E includes a power supply circuit for development Ea, a power supply circuit for charging Eb, a power supply circuit for transfer Ec, and a power supply circuit for fixing Ed.

Ea: Power Supply Circuit for Development

The power supply circuit for development Ea applies a developing voltage to a developing roller of the developing device G.

Eb: Power Supply Circuit for Charging

The power supply circuit for charging Eb applies a charging voltage for charging the surface of the photoconductor PR to the charging roller CR.

Ec: Power Supply Circuit for Transfer

The power supply circuit for transfer Ec applies a transfer voltage to the transfer roller Rt.

Ed: Power Supply Circuit for Fixing

The power supply circuit for fixing Ed supplies power for heating a heater to the heating roller Fh of the fixation device F.

41: CRUM Reader

The CRUM reader 41 reads information on a CRUM as an example of a use state storage medium provided in the toner cartridge TC. Meanwhile, the CRUM reader 41 according to Example 1 has a function of writing, that is, updating the information on the CRUM.

Function of Controller C of Printer U

The controller C of the printer U has a function of outputting a control signal to each control element by executing a process in response to an input signal from the signal output element. That is, the controller C has the following functions.

C1: Image Formation Control Section

An image formation control section C1 controls the driving of each member of the printer U and an application timing of each voltage in accordance with image information which is input from the personal computer PC, to thereby execute a job which is an image forming operation.

C2: Power Supply Circuit Control Section

A power supply circuit control section C2 controls the power supply circuits Ea to Ed to thereby control a voltage applied to each member and power supplied to each member.

C3: Use State Information Acquisition Section

A use state information acquisition section C3 acquires use state information stored in the CRUM of the toner cartridge TC through the CRUM reader 41. Meanwhile, a cumulative replenishment time t1*a* which is a cumulative driving time during which the toner cartridge TC is driven is stored in the CRUM according to Example 1 as an example of use state information.

C4: Cumulative Replenishment Time Storage Section

A cumulative replenishment time storage section C4 stores the cumulative replenishment time t1 of the toner cartridge TC. Meanwhile, the cumulative replenishment time storage section C4 according to Example 1 stores a cumulative replenishment time t1 which is updated whenever the toner cartridge TC is driven.

C5: Replacement Determination Section

A replacement determination section C5 determines whether the toner cartridge TC is replaced. The replacement determination section C5 according to Example 1 determines that the toner cartridge TC has been replaced when the cumulative replenishment time t1 stored in the cumulative replenishment time storage section C4 and the cumulative replenishment time t1*a* acquired by the use state information acquisition section C3 are not consistent with each other, and determines that the toner cartridge TC has not been replaced when the times are consistent with each other. Meanwhile, when it is determined that the toner cartridge TC has been replaced, the replacement determination section C5 according to Example 1 updates the cumulative replenishment time t1 stored in the cumulative replenishment time storage section C4 to the cumulative replenishment time t1*a* acquired by the use state information acquisition section C3.

C6: Replenishment Timing Determination Section

A replenishment timing determination section C6 determines whether it's time to replenish a developer by driving the replenishment motor M2, in accordance with the amount of developer consumed in the developing device G. When the amount of developer in the developing device G is detected using a sensor not shown in the drawing and the detected amount is less than an amount which is set in advance, the replenishment timing determination section C6 according to Example 1 determines that it's time to replenish the developer. Meanwhile, the determination as to whether it's time to replenish a developer is not limited thereto. The determination may made by any known method of the related art such as determination based on the concentration of the developer or a cumulative value of the number of pixels written by the exposing device ROS.

C7: Current Time Clocking Section

A current time clocking section C7 measures a current time. The current time clocking section C7 according to Example 1 is configured with a so-called built-in timepiece.

C8: Motor Stop Time Storage Section

A motor stop time storage section C8 stores a time at which the replenishment motor M2 is stopped. The motor stop time storage section C8 according to Example 1 stores a time measured by the current time clocking section C7 when the replenishment motor M2 is stopped, as a stopped time.

C9: Non-Driving Time Computation Section

A non-driving time computation section C9 computes a non-driving time t2 which is a period of time during which the replenishment motor M2 is stopped. The non-driving time computation section C9 according to Example 1 computes, as a non-driving time t2, an elapsed time from the motor stop time stored in the motor stop time storage section C8 to a time at which the replenishment motor M2 is started to operate, that is, the current time in a case where it is determined that a replenishment timing is set.

C10: Non-Driving Threshold Value Storage Section

A non-driving threshold value storage section C10 stores a non-driving threshold value tc which is set in advance. The non-driving threshold value tc is used in order to determine whether the non-driving time t2 is such a long period of time that it is necessary to perform an operation of breaking down a developer inside the toner cartridge TC.

C11: Non-Driving Threshold Value Correcting Section

A non-driving threshold value correcting section C11 includes a correction magnification storage section C11A, and corrects the non-driving threshold value tc. The non-driving threshold value correcting section C11 according to Example 1 corrects the non-driving threshold value tc in accordance with the environmental temperature and the environmental humidity respectively measured by the sensors SN1 and SN2. That is, the non-driving threshold value tc is corrected by estimating the easiness of coagulation of a developer fluctuating depending on a temperature and humidity during a period of time for which the toner cartridge TC is not used. Meanwhile, the configuration in which the non-driving threshold value tc is corrected in accordance with an environment is illustrated in Example 1, but the present invention is not limited thereto. A configuration in which the non-driving time t2 is corrected or a configuration in which both of the non-driving threshold value tc and the non-driving time are corrected may be adopted.

C11A: Correction Magnification Storage Section

The correction magnification storage section C11A stores a correction magnification as an example of a correction value used when the non-driving threshold value tc is corrected. In Example 1, a correction magnification $\alpha 1$ in a case of a high temperature and high humidity environment in which an environmental temperature is higher than a temperature which is set in advance and an environmental humidity is higher than a humidity which is set in advance, a correction magnification $\alpha 2$ in a case of a low temperature and low humidity environment, and a correction magnification $\alpha 3$ in other cases are set to values satisfying the relation of $\alpha 1<\alpha 3<\alpha 2$. Meanwhile, in Example 1, as an example, the relation of correction magnification $\alpha 3=1$ is established. Therefore, in the high temperature and high humidity environment, a non-driving threshold value $tc\times\alpha 1$ after correction is minimum, and thus there is a tendency for an operation of breaking down a developer to be determined to be necessary even when the non-driving time t2 is short.

C12: Long-Term Non-Driving Determination Section

A long-term non-driving determination section C12 determines whether the toner cartridge TC has been set to be in a non-driving mode for a long period of time, based on the non-driving time t2 and the non-driving threshold value tc. The long-term non-driving determination section C12 according to Example 1 determines whether the non-driving time t2 is equal to or greater than the non-driving threshold value tc after correction to thereby determine whether a non-driving mode has been set for a long period of time.

C13: Break-down Time Computation Section

A break-down time computation section C13 computes a break-down time t3 which is a time for which an operation of breaking down a developer inside the toner cartridge TC is performed. The break-down time computation section C13 according to Example 1 computes, as the break-down time t3, a time corrected with magnifications $\alpha 1$ to $\alpha 3$ in accordance with an environment with respect to a reference break-down time t3*a* which is set in advance.

TM: Timer

A timer TM clocks a time for which the replenishment motor M2 is driven.

C14: Cumulative Replenishment Time Measurement Section

A cumulative replenishment time measurement section C14 measures a cumulative replenishment time t1 which is a cumulative time during which a developer is replenished from the toner cartridge TC. The cumulative replenishment time measurement section C14 according to Example 1 measures and accumulates a driving time of the replenishment motor M2.

C15: Cumulative Replenishment Time Updating Section

A cumulative replenishment time updating section C15 updates the cumulative replenishment time t1 stored in the cumulative replenishment time storage section C4. The cumulative replenishment time updating section C15 according to Example 1 updates the cumulative replenishment time t1 after the replenishment motor M2 having been driven is stopped. Meanwhile, the cumulative replenishment time updating section C15 according to Example 1 updates the cumulative replenishment time t1 of the cumulative replenishment time storage section C4 and updates the cumulative replenishment time t1*a* of the CRUM of the toner cartridge TC.

C16: Initial Determination Value Storage Section

An initial determination value storage section C16 stores an initial determination value ta for determining whether it reaches timing which is set in advance after it has been started to use the toner cartridge TC. The initial determination value ta according to Example 1 is used in order to determine whether a first period of time set in advance has elapsed since a non-use state of the toner cartridge TC. Specifically, in Example 1, a value equivalent to a driving time of the replenishment motor M2 until a quarter of a developer of the toner cartridge TC is discharged is set as the initial determination value ta which is an example of an initial determination value and as an example of the first period of time.

C17: Ending Determination Value Storage Section

An ending determination value storage section C17 stores an ending determination value tb for determining whether it reaches timing at which a developer of the toner cartridge TC is likely to run out. The ending determination value tb according to Example 1 is set based on a small amount of developer inside the toner cartridge TC which is set in advance. Specifically, in Example 1, as an example of the ending determination value tb as an ending determination value, a value equivalent to a driving time of the replenishment motor M2 until three-quarters of the developer inside the toner cartridge TC are discharged is set.

C18: Driving Mode Setting Section

A driving mode setting section C18 as an example of a driving mode setting section includes an initial mode storage section C18A as an example of an initial driving mode storage section, a normal mode storage section C18B as an example of a middle driving mode storage section, and an ending mode storage section C18C as an example of an ending driving mode storage section. The driving mode setting section C18 sets a driving mode of the replenishment motor M2 according to the amount of developer inside the toner cartridge TC based on the cumulative replenishment time t1 and the determination values ta and tb.

C18A: Initial Mode Storage Section

The initial mode storage section C18A stores an initial mode as an example of a driving mode of the replenishment motor M2 in a case where the state of the toner cartridge TC is close to a non-use state. In the initial mode according to Example 1, when the replenishment motor M2 is driven in accordance with the amount of developer replenished, an operation of driving the replenishment motor at a rotation angle of $(n+\frac{1}{2})\pi\pm18$ degrees and then stopping the replenishment motor is repeated. That is, in the initial mode, the replenishment motor M2 is intermittently rotated at a rotation angle in a range of $(n+\frac{1}{2})\pi\pm18$ degrees. Meanwhile, in Example 1, as an example, n is set to 0, and the rotation angle is set to 90 degrees $(=(\frac{1}{2})\cdot\pi)$.

C18B: Normal Mode Storage Section

The normal mode storage section C18B stores a normal mode as an example of a driving mode of the replenishment motor M2 in a case where the toner cartridge TC has been used to a certain degree. In the normal mode according to Example 1, the replenishment motor M2 is continuously driven for a replenishment period according to the amount of developer replenished, unlike the initial mode. In the normal mode according to Example 1, a rotational speed, that is, the number of rotations per unit time is set to be a value greater than that in the initial mode.

C18C: Ending Mode Storage Section

The ending mode storage section C18C stores an ending mode as an example of a driving mode of the replenishment motor M2 in a case where a small amount of developer inside the toner cartridge remains. In the ending mode according to Example 1, when the replenishment motor M2 is driven in accordance with the amount of developer replenished, an operation of driving the replenishment motor in a range of less than 90 degrees and then stopping the replenishment motor is repeated. That is, in the ending mode, the replenishment motor M2 is intermittently rotated at a rotation angle in a range from equal to or greater than 3 degrees and less than 90 degrees. Meanwhile, in Example 1, as an example, the rotation angle during the intermittent driving is set to 12 degrees. Meanwhile, in the ending mode according to Example 1, a rotational speed is set to a value greater than that in the normal mode.

C19: Motor Driving Control Section

A motor driving control section C19 rotates the rotational portions 1 and 11 of the toner cartridge TC by driving the replenishment motor M2 through the replenishment motor driving circuit D2. The motor driving control section C19 according to Example 1 drives the replenishment motor M2 in accordance with the amount of rotation, based on the amount of developer replenished to the developing device G, and the modes set by the driving mode setting section C18. Meanwhile, in Example 1, the amount of developer replenished through one replenishment operation is set in advance. That is, the amount of rotation of each of the rotational portions 1 and 11 in one replenishment operation is also determined in advance. Accordingly, a driving time of the replenishment motor M2 in one replenishment operation, that is, a replenishment time t4 is also determined in advance in accordance with the rotational speeds in the respective modes.

Description of Flow Diagram According to Example 1

Next, a description will be given using a flowchart illustrating a flow of control in the printer U according to Example 1, that is, a so-called flow chart.

Figure 7:
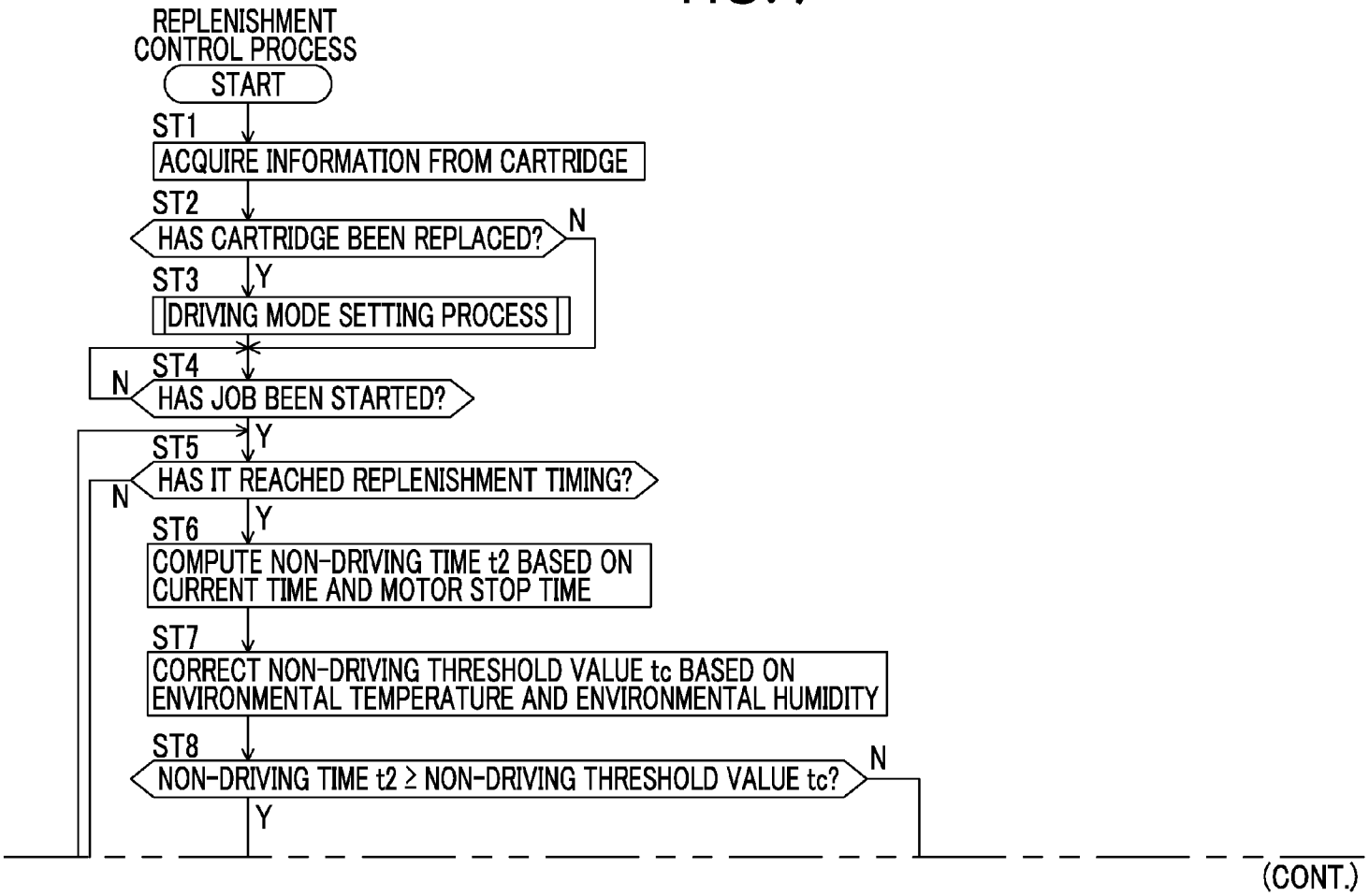
FIG. 7 is a flow chart illustrating a replenishment control process for the toner cartridge according to Example 1 of the present invention.

Description of Flow Chart Illustrating Control of Replenishment of Toner Cartridge FIG. 7 is a flow chart illustrating a replenishment control process for the toner cartridge according to Example 1 of the present invention.

Processes of respective steps ST in the flow chart of FIG. 7 are performed in accordance with programs stored in the controller C of the printer U. In addition, the processes are executed in parallel with various other processes of the printer U.

The flowchart illustrated in FIG. 7 is started by a power supply of the printer U is turned on.

In ST1 of FIG. 7, use state information is acquired from the toner cartridge TC, and the flow proceeds to ST2.

In ST2, it is determined whether the toner cartridge TC has been replaced by comparing the cumulative replenishment time t1 stored in the printer U with the cumulative replenishment time t1*a* acquired from the toner cartridge TC. In a case of Yes (Y), the flow proceeds to ST3. In a case of No (N), the flow proceeds to ST4.

In ST3, a driving mode setting process of setting a driving mode of the replenishment motor M2 driving the toner cartridge TC is executed, and the flow proceeds to ST4. Meanwhile, the driving mode setting process will be described later with reference to FIG. 8.

In ST4, it is determined whether a job has been started. In a case of Yes (Y), the flow proceeds to ST5. In a case of No (N), the flow repeatedly performs ST4.

In ST5, it is determined whether it reaches a replenishment timing at which a developer is replenished from the toner cartridge TC. In a case of Yes (Y), the flow proceeds to ST6. In case of No (N), the flow proceeds to ST16.

In ST6, a non-driving time t2 is computed based on the current time and the stop time at which the previous replenishment motor M2 is stopped, and the flow proceeds to ST7.

In ST7, a non-driving threshold value tc is corrected based on an environmental temperature and an environmental humidity, and the flow proceeds to ST8.

In ST8, it is determined whether the non-driving time t2 is equal to or greater than the non-driving threshold value tc. In case of Yes (Y), the flow proceeds to ST9. In case of No (N), the flow proceeds to ST13.

In ST9, the next processes (1) and (2) are executed, and the flow proceeds to ST10.

(1) A driving mode is set to an initial mode.

(2) A break-down time t3 is computed based on a rotational speed in the initial mode and the amount of rotation in one replenishment operation.

In ST10, the next processes (1) to (3) are executed, and the flow proceeds to ST11.

(1) A break-down time t3 is set in the timer TM.

(2) It is started to measure a cumulative replenishment time t1.

(3) It is started to drive the replenishment motor M2. Meanwhile, in ST10, the driving is started in the initial mode.

In ST11, it is determined whether the timer TM has entered a time-up state, that is, whether the break-down time t3 has elapsed. In case of Yes (Y), the flow proceeds to ST12. In case of No (N), ST11 is repeatedly performed.

In ST12, the next processes (1) and (2) are executed, and the flow proceeds to ST15.

(1) The replenishment motor M2 is stopped.

(2) The measurement of the cumulative replenishment time t1 is terminated. Meanwhile, at this time, pieces of information of the cumulative replenishment time storage section C4 and the CRUM are updated.

In ST13, the next processes (1) to (3) are executed, and the flow proceeds to ST14.

(1) A replenishment time t4 is set in the timer TM in accordance with the driving mode.

(2) It is started to measure a cumulative replenishment time t1.

(3) It is started to drive the replenishment motor M2.

In ST14, it is determined whether the timer TM has entered a time-up state, that is, whether the replenishment time t4 has elapsed. In case of Yes (Y), the flow proceeds to ST12. In case of No (N), ST14 is repeatedly performed.

In ST15, a driving mode setting process of setting a driving mode of the replenishment motor M2 driving the toner cartridge TC is executed, and the flow proceeds to ST16. Meanwhile, the driving mode setting process will be described later with reference to FIG. 8.

In ST16, it is determined whether a job has been terminated. In case of Yes (Y), the flow returns to ST1. In case of No (N), the flow returns to ST5.

Description of Driving Mode Setting Process

Figure 8:
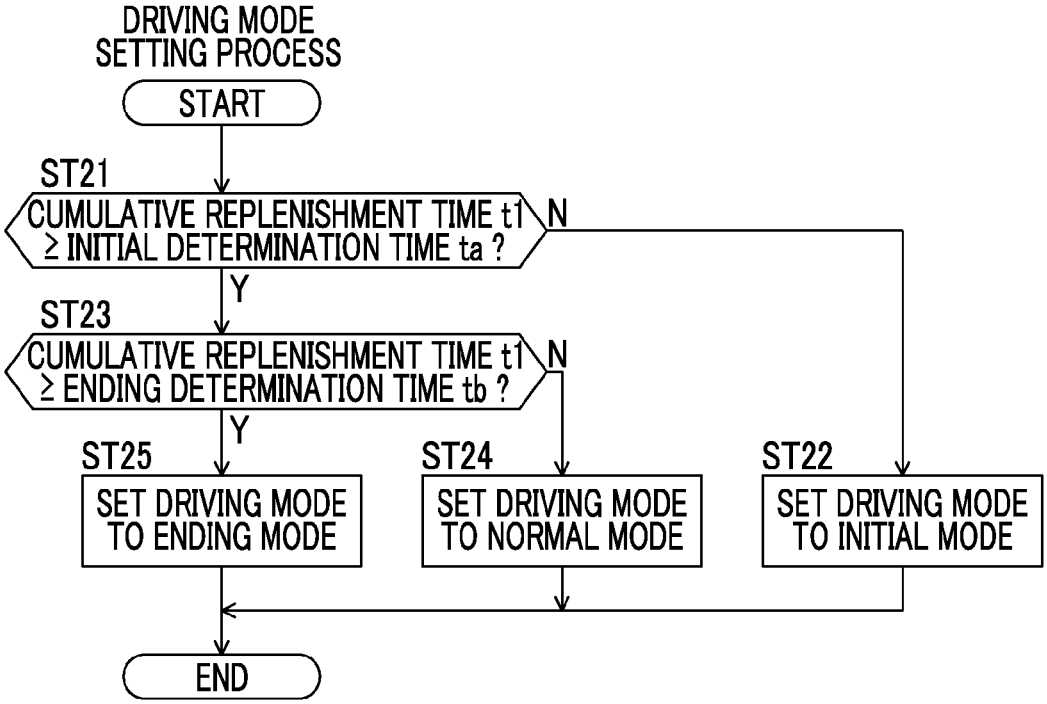
FIG. 8 is a diagram illustrating a driving mode setting process according to Example 1, and is a flow chart of subroutines of ST3 and ST15 in FIG. 7.

FIG. 8 is a diagram illustrating a driving mode setting process according to Example 1, and is a flow chart of subroutines of ST3 and ST15 in FIG. 7.

In ST21 of FIG. 8, it is determined whether the cumulative replenishment time t1 is equal to or greater than an initial determination value ta. In case of No (N), the flow proceeds to ST22. In case of Yes (Y), the flow proceeds to ST23.

In ST22, a driving mode is set to an initial mode. In addition, the driving mode setting process is terminated, and the flow returns to the process in FIG. 7.

In ST23, it is determined whether the cumulative replenishment time t1 is equal to or greater than an ending determination value tb. In case of No (N), the flow proceeds to ST24. In case of Yes (Y), the flow proceeds to ST25.

In ST24, a driving mode is set to a normal mode. In addition, the driving mode setting process is terminated, and the flow returns to the process in FIG. 7.

In ST25, a driving mode is set to an ending mode. In addition, the driving mode setting process is terminated, and the flow returns to the process in FIG. 7.

Action According to Example 1

In the printer U according to Example 1 having the above-described configuration, when a power supply is turned on, it is determined whether the toner cartridge TC has been replaced. When the toner cartridge TC has been replaced, a driving mode is set in accordance with the cumulative replenishment time t1 of the toner cartridge TC in the process of ST3. Meanwhile, when the toner cartridge TC has not been replaced, a driving mode is not set, and the driving mode having been set up to that time remains intact. Next, when a job is started and a replenishment timing is set, it is determined in the processes of ST7 and ST8 whether the toner cartridge TC has not been used for a long period of time. When the toner cartridge has been frequently used, a replenishment operation is executed in accordance with the driving mode in the processes of ST13 and ST14.

Description of Initial Mode

Figure 9A:
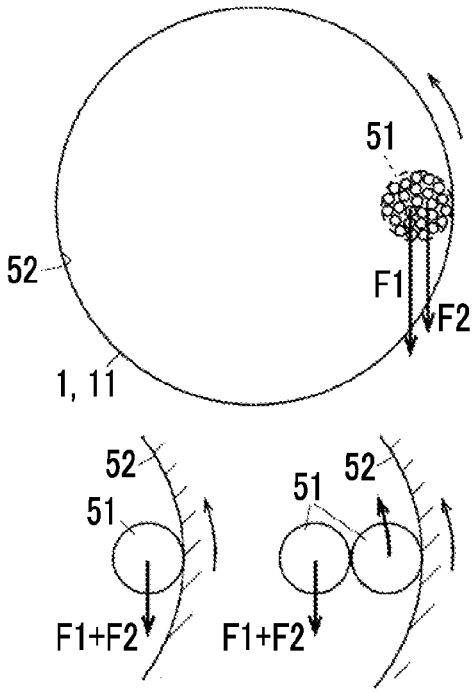
FIGS. 9A to 9D are diagrams illustrating how a developer is broken down in an initial mode according to Example 1.
Figure 9B:
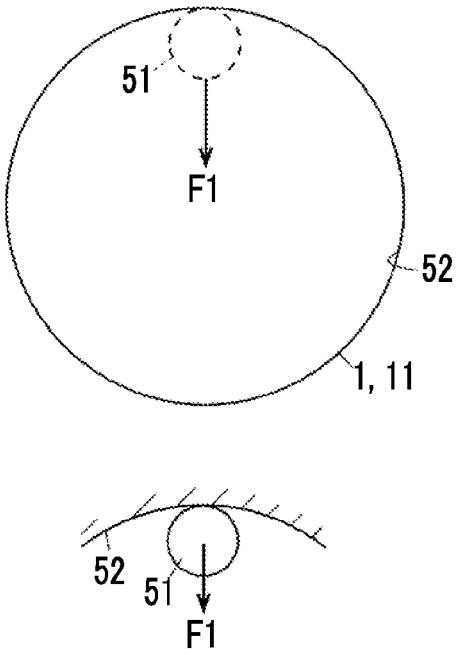
Figure 9C:
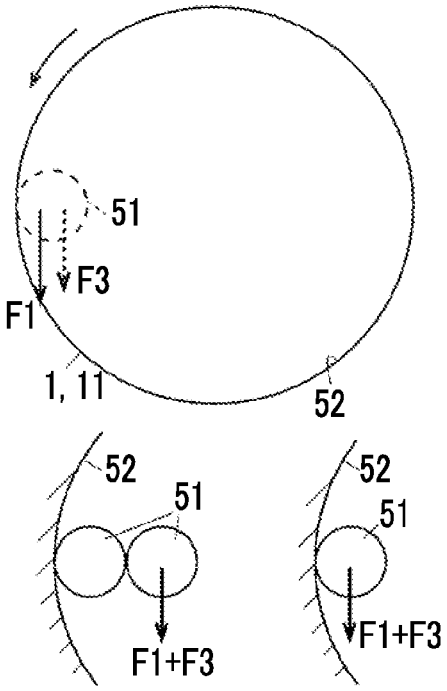
Figure 9D:
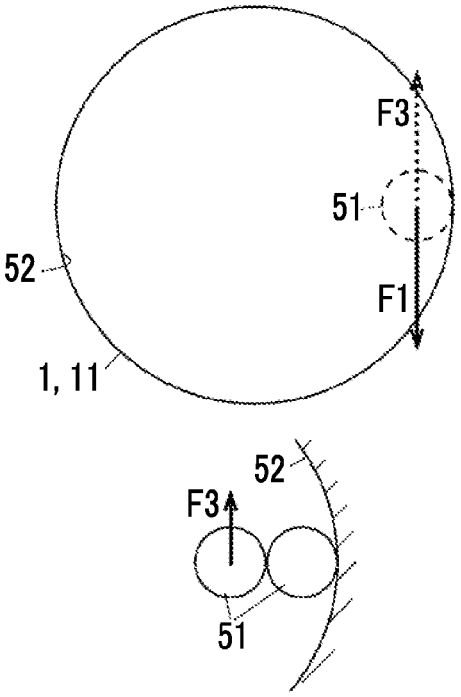

FIGS. 9A to 9D are diagrams illustrating how a developer is broken down in an initial mode according to Example 1. FIG. 9A is a diagram illustrating a force acting on the developer when rotation is started, FIG. 9B is a diagram illustrating a state where the rotational portions are rotated by 90 degrees from the state in FIG. 9A, FIG. 9C is a diagram illustrating a force acting when the rotational portions are rotated by 90 degrees from the state in FIG. 9B and is then stopped, and FIG. 9D is a diagram illustrating a force acting when the rotational portions are rotated by 180 degrees from the state in FIG. 9C and is then stopped.

In an initial mode, the replenishment motor M2 performs intermittent driving of repeatedly rotating the rotational portions 1 and 11 by 90 degrees and stopping the rotational portions. When the state of the toner cartridge TC is close to a non-use state, a developer may be pressed together and aggregated due to vibration during preservation in a warehouse or during transportation, or may be attached to a wall surface. On the other hand, in Example 1, in FIG. 9A, when it is started to rotate the rotational portions 1 and 11, an inertial force F2 acts on a developer 51 attached to a right side surface, in addition to gravity F1. Therefore, a rubbing force F1+F2 of the developer 51 acts on a wall surface 52 of the rotational portions 1 and 11, or the rubbing force F1+F2 acts between a developer attempting to move integrally with the wall surface and an adjacent developer on the inner side thereof. Accordingly, there is a tendency for adhesion between the developer and the wall surface 52 or adhesion between the developers to be lowered. Accordingly, the developer 51 is separated from the wall surface 52, or the developers are loosened, and thus the coagulation of the developer may be loosened. When the rotational portions 1 and 11 are rotated by 90 degrees and then stopped, the gravity F1 acts on the developer as illustrated in FIG. 9B. At this time, the gravity F1 acts as a force for separating the developer 51 from the wall surface 52. Therefore, the developer having a reduced adhesion is separated from the wall surface 52, or the developer on the inner side thereof falls and tends to break and fall. Accordingly, in the toner cartridge TC according to Example 1, there is a lower possibility of a developer being continuously attached to the same position on the inner surface of the bottle 1 than in a case where intermittent driving of repeatedly rotating the rotational portions 1 and 11 by 90 degrees and stopping the rotational portions is not performed.

When the rotation angles of the rotational portions 1 and 11 are angles other than approximately 90 degrees, the developer having a reduced adhesion is not stopped at the position illustrated in FIG. 9B, and the direction of the gravity F1 is set to a direction in which the developer 51 is separated from the wall surface 52, that is, a direction inclined to the normal direction of the wall surface 52. Accordingly, in this case, a force and efficiency of separating the developer 51 from the wall surface 52 are reduced. On the other hand, in Example 1 in which a rotation angle is 90 degrees, a developer attached to the wall surface 52 is peeled off more easily than in a case where the rotation angle is an angle other than approximately 90 degrees. Accordingly, the surrounding developers are also broken down in a manner of being caught in the developer peeled off from the wall surface 52, and thus the coagulated developer is loosened.

In FIGS. 9B and 9C, even when the developer 51 is not separated from the wall surface 52 in the state illustrated in FIG. 9B, adhesion between the developer 51 and the wall surface 52 tends to be further lowered due to the gravity F1 in the state illustrated in FIG. 9B. When the rotational portions are rotated until the state illustrated in FIG. 9C is set, an inertial force F3 when the rotation is stopped acts in the same direction as the gravity F1. Therefore, when the rotation is stopped, the developer 51 is separated from the wall surface 52, and thus the break-down of the developer 51 is promoted.

In FIG. 9D, when the rotational portions 1 and 11 are rotated, is moved to a position illustrated in FIG. 9D, and is stopped, the inertial force F3 during the stopping of the rotation acts on the developer 51. Therefore, a rubbing force acts between the developers and between the developer 51 and the wall surface 52. Accordingly, there is tendency for adhesion between the developers and adhesion between the developer 51 and the wall surface 52 to be lowered. Accordingly, the developers tend to be broken down. During the next rotation of the rotational portions 1 and 11, the states illustrated in FIGS. 9A and 9B are set, and thus the developers tend to be broken down. The intermittent driving is repeated, and thus the developers tend to be broken down and loosened while suppressing manufacturing costs and assembling costs, compared to the related art in which an additional member of breaking down a developer is provided.

Meanwhile, when the rotation angle is 90 degrees, four surfaces of the wall surface 52 or the developer 51 in the circumferential direction are periodically moved to the positions illustrated in FIGS. 9A to 9D. When the rotation angle is set to be in a range of ±18 degrees, for example, 85 degrees or 95 degrees, the position of the wall surface 52 in the circumferential direction moving to the position illustrated in FIG. 9A or FIG. 9B is shifted little by little, and thus substantially the entire inner circumferential surface may be moved to the positions illustrated in FIGS. 9A to 9C.

Figure 10A:
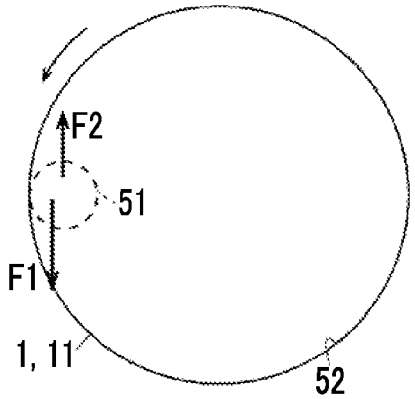
FIGS. 10A to 10D are diagrams illustrating how a developer is broken down in an initial mode according to a modification example of Example 1.
Figure 10B:
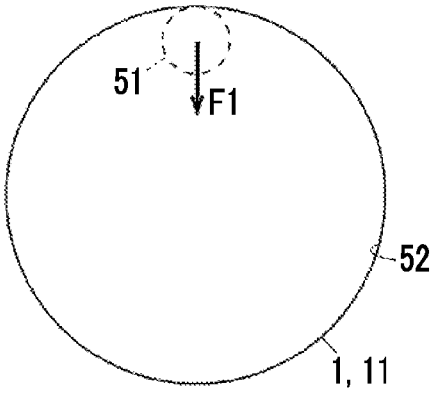
Figure 10C:
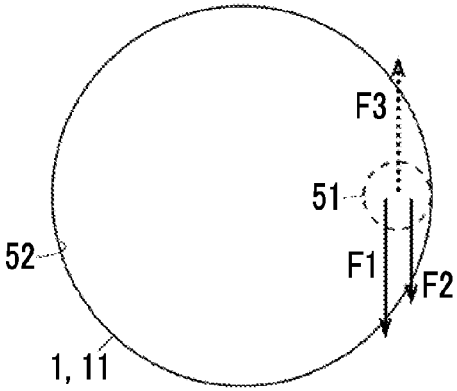
Figure 10D:
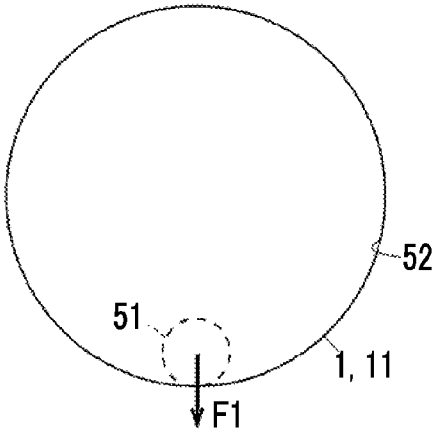

FIGS. 10A to 10D are diagrams illustrating how a developer is broken down in an initial mode according to a modification example of Example 1. FIG. 10A is a diagram illustrating a force acting on a developer when rotation is started, FIG. 10B is a diagram illustrating a state where a rotational portion is rotated by 270 degrees from the state in FIG. 10A, FIG. 10C is a diagram illustrating a state where the rotational portion is rotated by 270 degrees from the state in FIG. 10B, and FIG. 10D is a diagram illustrating a state where the rotational portion is rotated by 270 degrees from the state in FIG. 10C.

In FIGS. 9A to 9D and FIGS. 10A to 10D, a case where a rotational portion is rotated by 270 degrees and is then stopped will be considered, instead of a case where a rotational portion is rotated by 90 degrees and is then stopped in Example 1. In FIG. 10A, when it is started to rotate the rotational portions 1 and 11, gravity F1 and an inertial force F2 act, and thus adhesion between developers or adhesion between the developer 51 and the wall surface 52 may be lowered similar to the case illustrated in FIG. 9D. In addition, the state illustrated in FIG. 10B is set, the developer tends to break and fall due to gravity F1. When the rotational portions transition to the state illustrated in FIG. 10C by the rotation from the state illustrated in FIG. 10B, an inertial force F3 acts when the rotation is stopped, and thus the developers tend to be broken down. When it is started to rotate the rotational portions from the state illustrated in FIG. 10C, the inertial force F2 in the same direction as the gravity F1 acts, which leads to a state where the developers tend to be broken down. In addition, when the rotational portions are rotated to the state illustrated in FIG. 10A through the state illustrated in FIG. 10D and are then stopped, the inertial force F3 in the same direction as the gravity F1 acts, which results in a reduction in the adhesion of the developer.

Description of Ending Mode

Figure 11A:
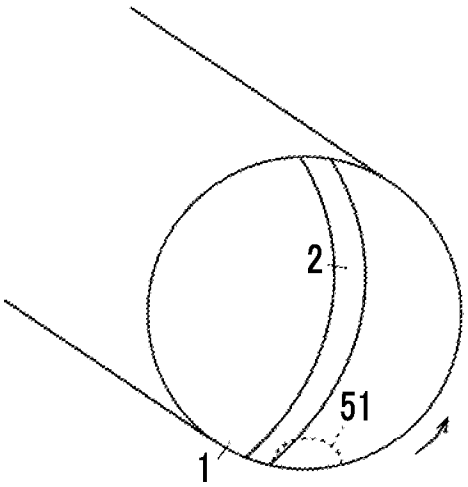
FIGS. 11A to 11C are diagrams illustrating how the developer moves in an ending mode according to Example 1.
Figure 11B:
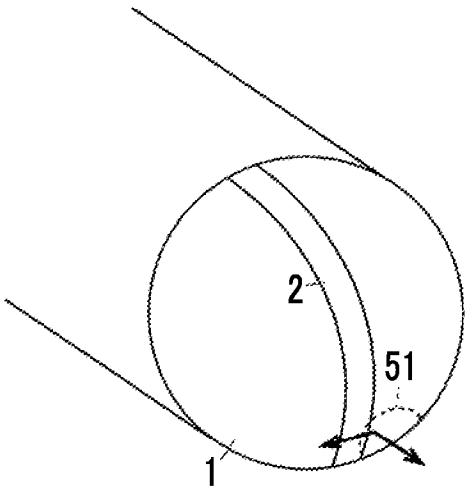
Figure 11C:
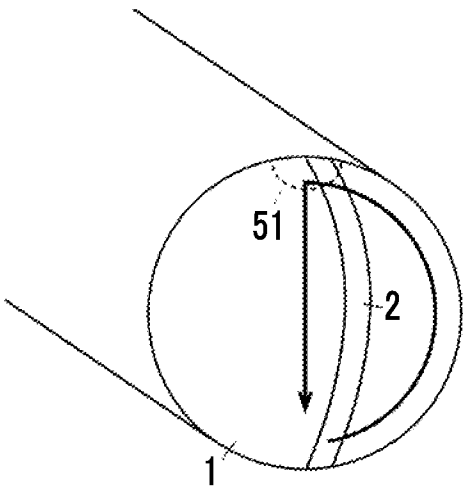

FIGS. 11A to 11C are diagrams illustrating how the developer moves in the ending mode according to Example 1. FIG. 11A is a diagram illustrating a state before driving is started, FIG. 11B is a diagram illustrating a state after the driving is terminated, and FIG. 11C is a diagram illustrating a case where the rotational portion is stopped at a position where the rotational portion is rotated by 180 degrees.

In the ending mode according to Example 1, the replenishment motor M2 is intermittently driven at a rotation angle of 12 degrees. In FIGS. 11A and 11B, when the rotation of the bottle 1 is stopped in a case where a rotation angle of the bottle 1 during intermittent driving is less than 90 degrees, a developer tends to move toward the bottom of the bottle 1 due to gravity. At this time, the developer tends to move toward the bottom so as to slide along the inner surface of the bottle 1. In addition, even when the developer is not moved, the developer receives an inertial force in a direction directed to the bottom of the bottle 1 when rotation is started next time. Accordingly, the developer directed to the bottom is also moved in the axial direction along the helical-shaped groove portion 2. Accordingly, the developer is transported toward the exit port 28.

When the rotation angles of the rotational portions 1 and 11 are greater than 90 degrees, the developer receives a centrifugal force during the rotation of the rotational portions 1 and 11, and thus the developer is continuously attached to the same position on the inner surface of the bottle 1. As illustrated in FIG. 11C, when the rotational portions are stopped at a position where the rotational portions are rotated by 90 degrees or more, the developer falls in a manner of being separated from the inner surface of the bottle 1. Therefore, the developer falls without touching the helical-shaped groove portion 2. Accordingly, the developer is rotated only in the circumferential direction, and the position of the developer in the axial direction is not changed. That is, the developer is hardly transported toward the exit port 28. Therefore, the toner cartridge TC may be replaced in a state where a small amount of developer inside the bottle 1 remains without being transported to the exit port 28.

On the other hand, in Example 1, in the ending mode, control is changed from the initial mode or the normal mode, and thus intermittent driving is performed at a rotation angle of less than 90 degrees. Accordingly, even when the amount of developer inside the bottle 1 is small, a developer tends to be transported to the exit port 28. Accordingly, a smaller amount of developer remains in the toner cartridge TC than in a case where the control of rotation at equal to or greater than 90 degrees is performed until the developer inside the toner cartridge TC runs out. In addition, in the toner cartridge TC according to Example 1, there is a lower possibility of the developer being continuously attached to the same position on the inner surface of the bottle 1 than in a case where intermittent driving of repeatedly rotating the rotational portions 1 and 11 by less than 90 degrees and stopping the rotational portions is not performed. Therefore, in principle, even when the rotation angle is less than 90 degrees, it is preferable that the rotation angle is small like 12 degrees in Example 1. However, when the rotation angle is excessively small, driving and stopping are frequently performed, and thus a time required for replenishment increases as a total stop time increases. Accordingly, modifications may be appropriately made depending on experiment, design, specifications, or the like.

In addition, in Example 1, rotational speeds of the rotational portions 1 and 11 increase in the order of the initial mode, the normal mode, and the ending mode. In the initial mode, a developer inside the rotational portions 1 and 11 may be coagulated, and thus the load of rotation during the driving of the replenishment motor M2 is large, which results in a problem in that power consumption is increased. In addition, in the initial mode, the amount of developer inside the rotational portions 1 and 11 is large, and the load of rotation is increased, which results in a tendency for the power consumption of the replenishment motor M2 to be increased. Meanwhile, the amount of power consumption of the motor varies depending on a load torque and a rotational speed.

On the other hand, in Example 1, in the initial mode, the developer is broken down, and thus the load of rotation is reduced, and the rotational speeds of the rotational portions 1 and 11 are set to be low. Accordingly, also in the initial mode, the power consumption of the replenishment motor M2 is reduced, compared to a case where rotation is performed at the same rotational speed as in the normal mode.

In addition, even when rotation is performed at the same rotational speed in a state where the amount of developer is small, there is a tendency for the amount of developer transported to the exit port 28 by the groove portion 2 to be reduced, compared to a state where a sufficient amount of developer remains. Accordingly, there is a problem in that the amount of developer discharged from the exit port 28 is not likely to be stabilized. On the other hand, in Example 1, a rotational speed increases in the ending mode, and thus the amount of developer transported per unit time is increased, and the stability of discharge of the developer is also improved, compared to a case where a rotational speed does not fluctuate.

In particular, in Example 1, intermittent driving is performed at a rotation angle of less than 90 degrees, and thus there is a higher tendency for the developer to be transported in a transport direction than in a case of 90 degrees or more. Accordingly, there is a tendency for the developer to be discharged stably.

Further, in Example 1, in the normal mode or the ending mode, when the rotational portions 1 and 11 have not been driven for a long period of time, the rotational portions are driven in the initial mode. Therefore, a developer coagulated while the rotational portions are not driven for a long period of time is broken down. Accordingly, when the rotational portions are used for a long period of time, a load torque applied to the replenishment motor M2 is reduced, compared to a case where the rotational portions are driven in the normal mode.

In addition, in Example 1, when it is determined whether the rotational portions 1 and 11 have not been driven for a long period of time, a non-driving threshold value tc is correct in accordance with an environmental temperature and an environmental humidity. The degree at which a developer is coagulated varies depending on an environmental temperature and an environmental humidity. Accordingly, when a threshold value is constant regardless of an environment, there is a concern that an initial mode for breaking down the developer is not started in spite of the developer being coagulated, or that the initial mode is started in spite of the developer not being coagulated. On the other hand, in Example 1, the non-driving threshold value tc is corrected in accordance with an environment, and thus there is a tendency for the initial mode to be appropriately started, compared to a case where an environment is not considered.

Therefore, in the printer U according to Example 1, the rotational portions 1 and 11 are intermittently driven at a rotation angle based on the use state of the toner cartridge TC. Accordingly, in the printer U according to Example 1, a developer falls off from the inner surface of the bottle 1 and is not attached to the inner surface in an initial mode, and a situation rises in which the developer slips off along the inner surface of the bottle 1 during rotation in an ending mode. That is, the developer moves and flows to the inner surface of the bottle 1 without being continuously attached to the same position on the inner surface of the bottle 1. Therefore, in Example 1, the toner cartridge TC is intermittently driven at an appropriate angle during a former period of use and a latter period thereof, that is, when the amount of developer is large and when the amount of developer is small.

EXPERIMENT EXAMPLE

Experiment Example 1

Next, experiment for confirming effects of the example is performed.

In Experiment Example 1, experiment for confirming effects of an initial mode is performed. In the experiment, the amount of developer in a break-down failure state (weight of a developer which is attached to a wall surface without being broken down) is measured while changing a rotation angle in intermittent driving. In Experiment Example 1, an experiment apparatus to rotate the toner cartridge TC is manufactured, and the experiment is performed. The toner cartridge having been subjected to tapping 1000 times is used. In addition, the rotational speeds of the rotational portions 1 and 11 are 20 [rpm], 32 [rpm], and 40 [rpm].

Figure 12:
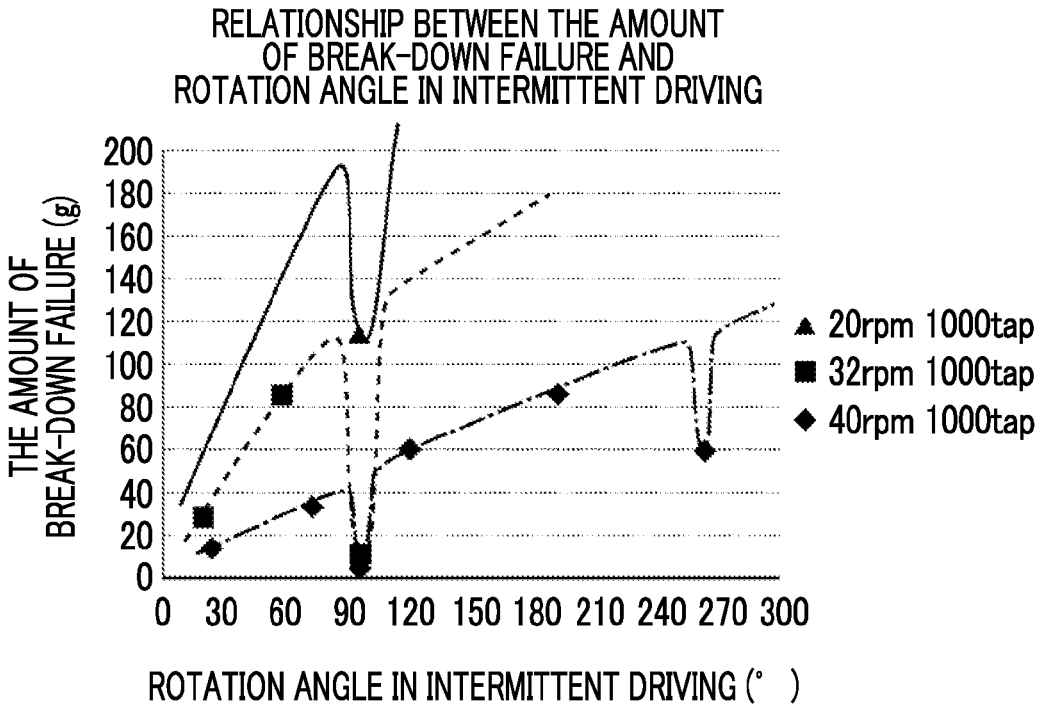
FIG. 12 is a diagram illustrating experiment results according to Experiment Example 1, and is a graph in which a horizontal axis represents a rotation angle in intermittent driving and a vertical axis represents the amount of breakdown failure.

Results thereof are shown in FIG. 12.

FIG. 12 is a diagram illustrating experiment results according to Experiment Example 1, and is a graph in which a horizontal axis represents a rotation angle in intermittent driving and a vertical axis represents the amount of break-down failure.

Meanwhile, in FIG. 12, measurement is actually performed by minutely changing an angle, but it is difficult to see experimental data, and thus only lines along representative values and measurement values are shown in the graph, and all of the measurement values are not shown in the graph.

As can be seen from FIG. 12, it is confirmed that the amount of break-down failure is specially decreased, that is, the amount of developer broken down is large when the rotation angle is approximately 90 degrees and 270 degrees. From the graph, it can be read that the amount of break-down failure is decreased within a range of $(n+\frac{1}{2})\pi\pm18$ degrees. Meanwhile, portions of depressions of the line in 90 degrees and 270 degrees were $(n+\frac{1}{2})\pi\pm6$ degrees. Accordingly, in a case of $(n+\frac{1}{2})\pi\pm18$ degrees, there is a tendency for the developer to be broken down, and thus it is confirmed that it is more preferable to set the rotation angle to $(n+\frac{1}{2})\pi\pm6$ degrees.

MODIFICATION EXAMPLE

While the example of the present invention has been described so far in detail, the present invention is not limited to the example, and various modifications may be made without departing from the scope of the invention described in claims. Modification Examples (H01) to (H08) will be described below.

(H01) In the example, a printer as an example of an image forming apparatus is described, but the present invention is not limited thereto. For example, the present invention may also be applied to an image forming apparatus such as a copying machine or a FAX.

(H02) In the example, the specific numerical values described may be modified depending on design, specifications, or the like. For example, the initial determination value ta and the ending determination value tb which are periods for which an initial mode is executed are set to ¼ and ¾, but modifications, such as setting of timings at which the amounts of developer discharged are 5% and 95% or changing of a specific numerical value of a rotation angle, may be appropriately made.

(H03) In the example, a configuration in which an initial mode is executed when a non-driving period is a long period of time has been described, but the present invention is not limited thereto. When the non-driving period is set to a long period of time, it is also possible to execute a mode for breaking down a developer which is different from the initial mode. For example, it is possible to make a change to any break-down mode as long as a developer may be broken down, such as backward rotation of the rotational portions 1 and 11 or setting of a rotational speed different from that in the initial mode.

(H04) In the example, it is preferable to adopt a configuration in which a rotational speed is increased in the order of an initial mode, a normal mode, and an ending mode, but the present invention is not limited thereto. For example, only a rotational speed in the initial mode is set to be low, and rotational speeds in the normal mode and the ending mode are set to be the same as each other. Alternatively, it is also possible to equalize rotational speeds in all of the modes.

(H05) In the example, it is preferable to provide the fin main body 13, but it is also possible to omit the fin main body.

(H06) In the example, a configuration in which the coupling 16 for driving the bottle 1 is provided at a rear end has been described, but the present invention is not limited thereto. For example, it is also possible to adopt a configuration in which a coupling shape is formed at the front end of the bottle 1 or the bottle 1 is driven by forming a gear on the outer circumferential surface of the bottle 1.

(H07) In the example, a configuration in which the toner seal 17 is disposed on the side of the rotational portions 1 and 11 and the projection portion 23*a* is disposed in the flange portion 21 has been described, but it is also possible to make an exchange.

(H08) In the example, it is preferable to correct the non-driving threshold value tc in accordance with an environment, but it is also possible to adopt a configuration in which the non-driving threshold value is not corrected. In addition, it is preferable to execute a break-down mode when the non-driving time period t2 is a long period of time, but it is also possible to adopt a configuration in which the break-down mode is not executed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an accommodation container that includes:

a rotational portion which accommodates a developer therein and which has a helical-shaped transport section formed in an inner surface thereof, an outflow portion which rotatably supports the rotational portion and which has an outflow port through which the developer transported during rotation of the rotational portion flows out, and a storage medium which stores use state information of the developer accommodated in the rotational portion; and a controller that controls a driving source which intermittently drives and stops the rotational portion, wherein when an amount of developer accommodated in the accommodation container for the developer is below a preset amount, the controller increases a rotational speed of the rotational portion, wherein when the rotational portion has not been driven for a period of dine equal to or long than a non-driving period which is set in advance, the controller drives the rotational portion for a period of time which is set in advance at an initial rotational speed as a rotational speed of the rotational portion in a case of replenishing a unit amount of developer.

2. The image forming apparatus according to claim 1, wherein when an amount of developer accommodated in the accommodation container for the developer is a small amount which is set in advance, the controller intermittently drives the rotational portion by performing the driving at the rotation angle less than 90 degrees and the stopping.

3. The image forming apparatus according to claim 1, further comprising:

an environment detecting section that detects an environmental temperature and an environmental humidity of the image forming apparatus; and a correcting section that corrects a period of time for which the rotational portion has not been driven, based on the environmental temperature and the environmental humidity.

* * * * *